US005301733A

United States Patent [19]

Toti

[11] Patent Number: 5,301,733

[45] Date of Patent: Apr. 12, 1994

[54] TAPE-SUPPORTED WINDOW COVER SYSTEM

[76] Inventor: Andrew J. Toti, 311 W. River Rd., Modesto, Calif. 95351

[21] Appl. No.: 934,989

[22] Filed: Aug. 25, 1992

[51] Int. Cl.[5] ..... E06B 3/94

[52] U.S. Cl. ..... 160/84.1 R; 160/89; 160/172

[58] Field of Search ..... 160/84.1, 89, 126, 172, 160/168.1, 166.1, 341, 345

[56] References Cited

U.S. PATENT DOCUMENTS

| | | | |
|---|---|---|---|
| 3,116,784 | 1/1964 | Dwyer | 160/349 |
| 3,335,784 | 8/1967 | Risk et al. | 160/199 |
| 3,369,589 | 2/1968 | Benkert, Jr. | 160/84 |
| 3,382,507 | 5/1968 | Micheau | 4/149 |
| 3,844,330 | 10/1974 | Hyman | 160/168.1 |
| 3,851,699 | 12/1974 | Shapiro | 160/168.1 |
| 3,946,789 | 3/1976 | Tolle | 160/168.1 |
| 4,123,820 | 11/1978 | Hamilton | 160/345 X |
| 4,202,395 | 5/1980 | Heck et al. | 160/84 |
| 4,473,101 | 9/1984 | Langeler | 160/84 |
| 4,582,109 | 4/1986 | Fairbanks | 160/84 |
| 4,862,941 | 9/1989 | Colson | 160/84.1 |
| 4,915,153 | 4/1990 | Toti | 160/84 |
| 5,083,598 | 1/1992 | Schon | 160/84.1 |

FOREIGN PATENT DOCUMENTS

| | | |
|---|---|---|
| 56179 | 5/1890 | Fed. Rep. of Germany . |
| 723769 | 6/1942 | Fed. Rep. of Germany . |

*Primary Examiner*—David M. Purol
*Attorney, Agent, or Firm*—Philip A. Dalton

[57] ABSTRACT

A cover system suitable for windows includes a tape support for maintaining the orientation of the cover and for opening and closing the cover.

23 Claims, 16 Drawing Sheets

FIG. 3
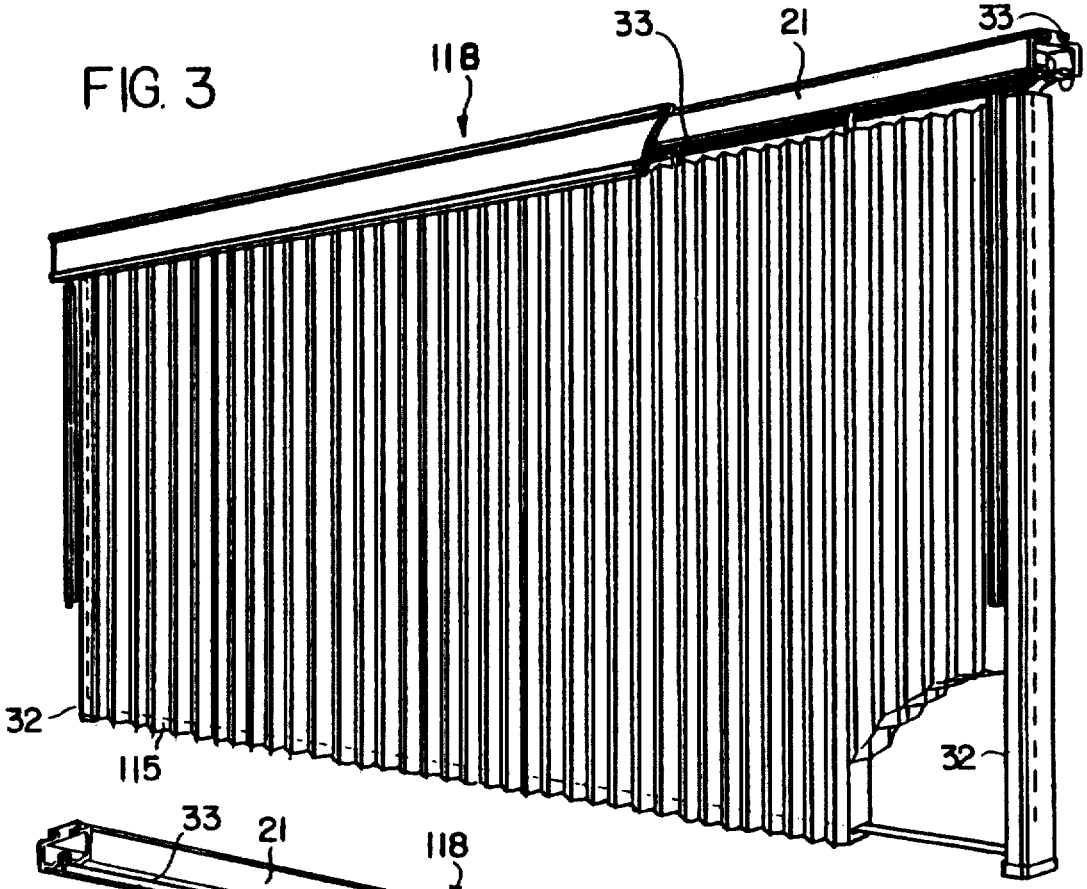
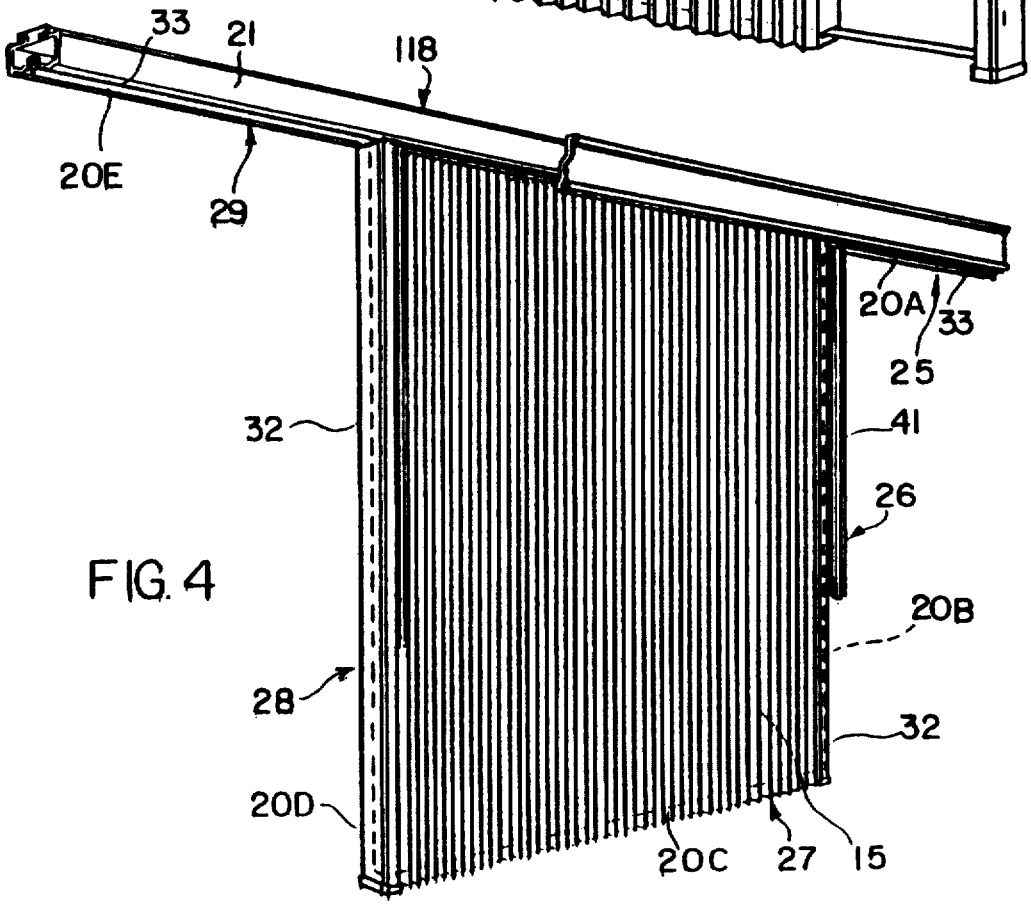
FIG. 4

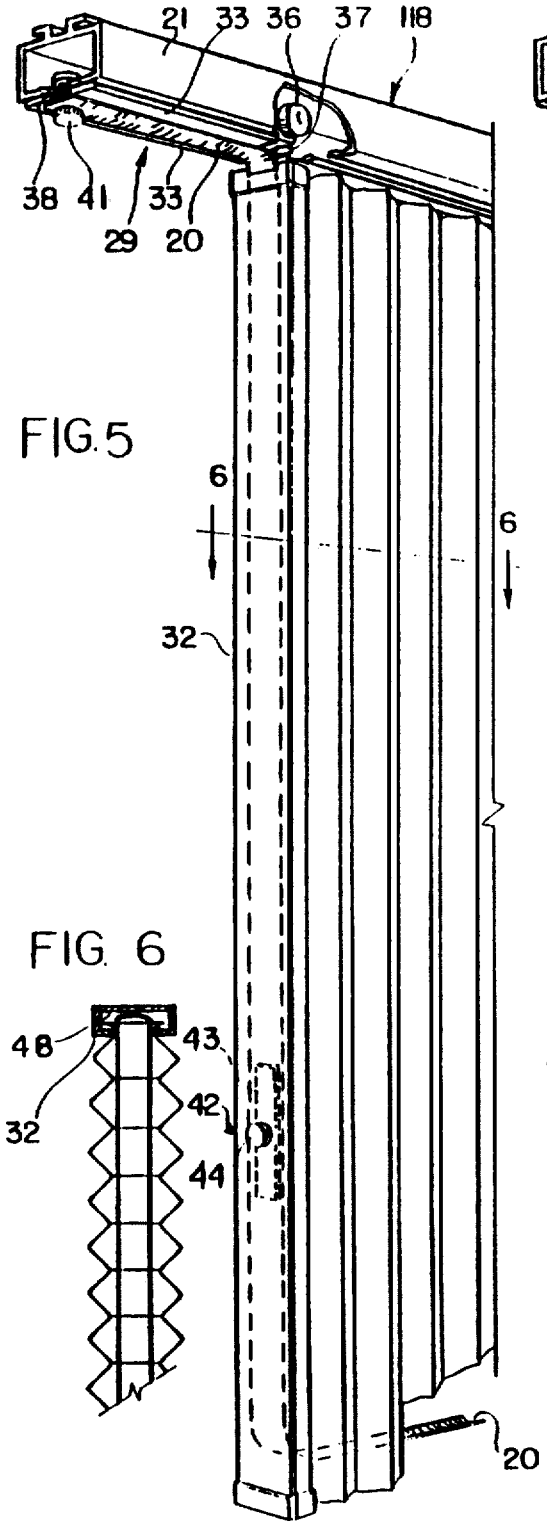
FIG. 5
FIG. 6
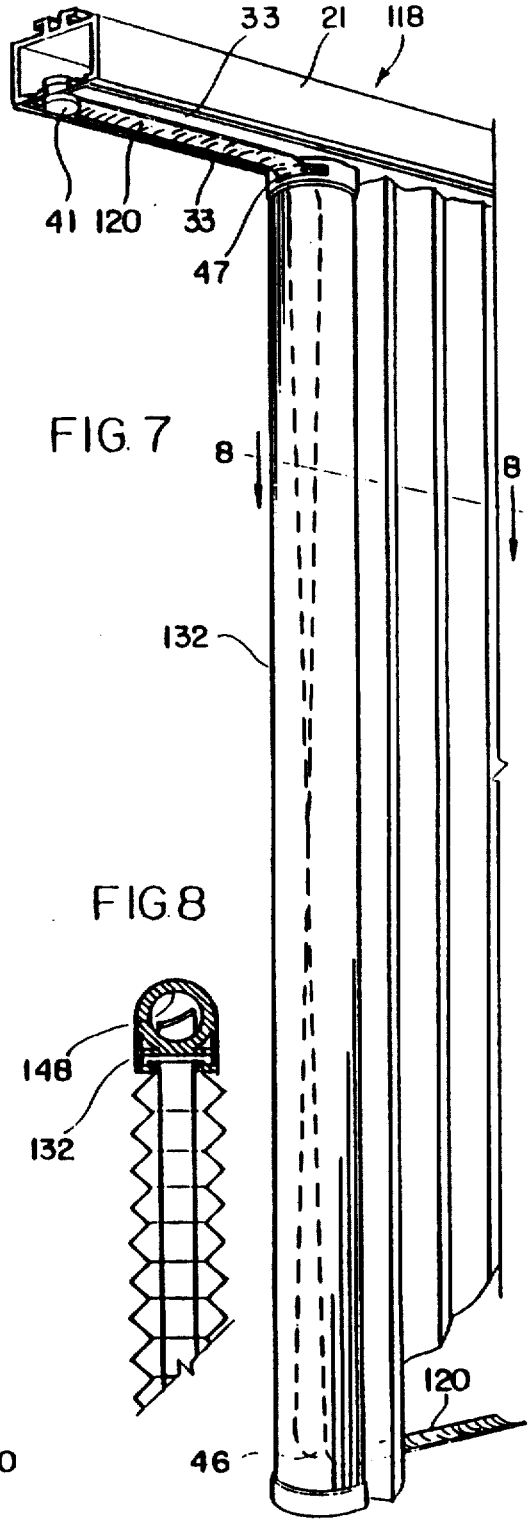
FIG. 7
FIG. 8

FIG. 24
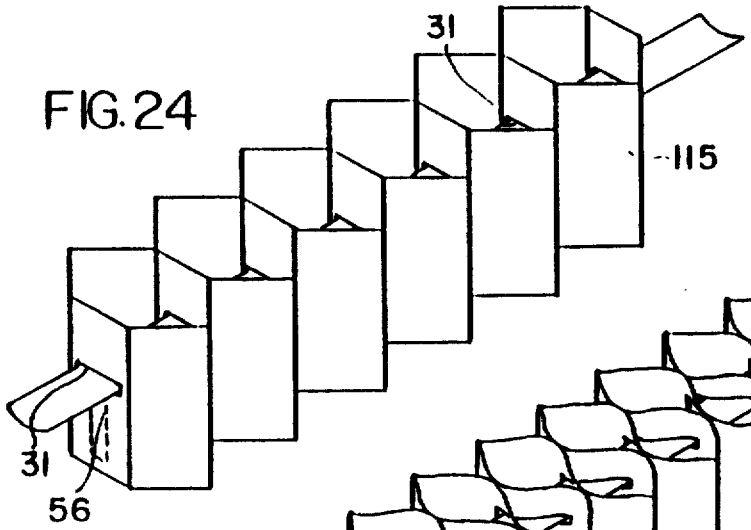
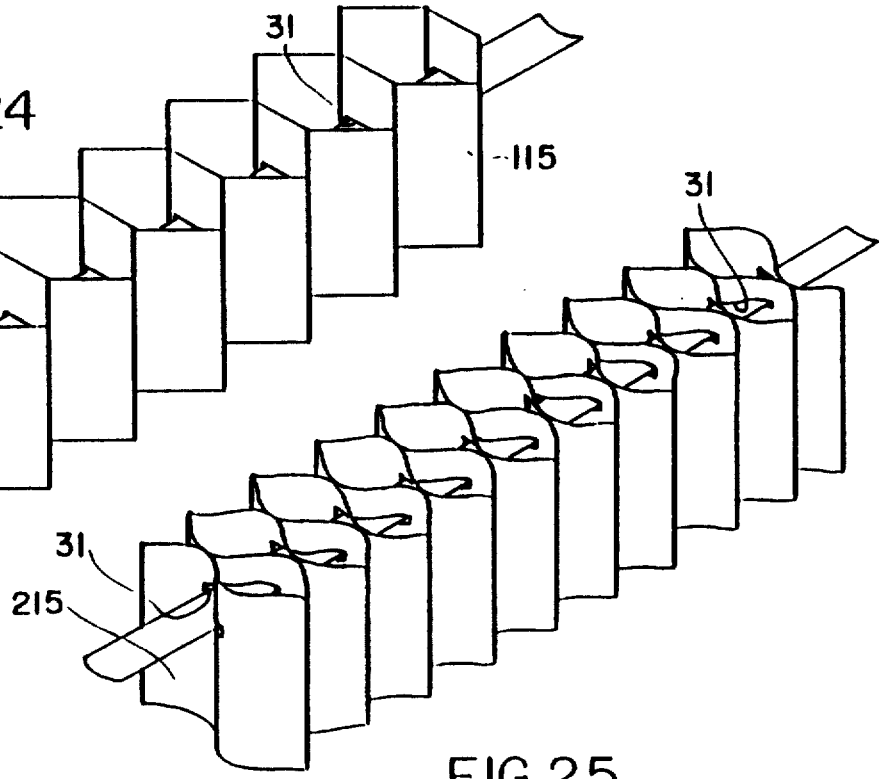
FIG. 25
FIG. 26
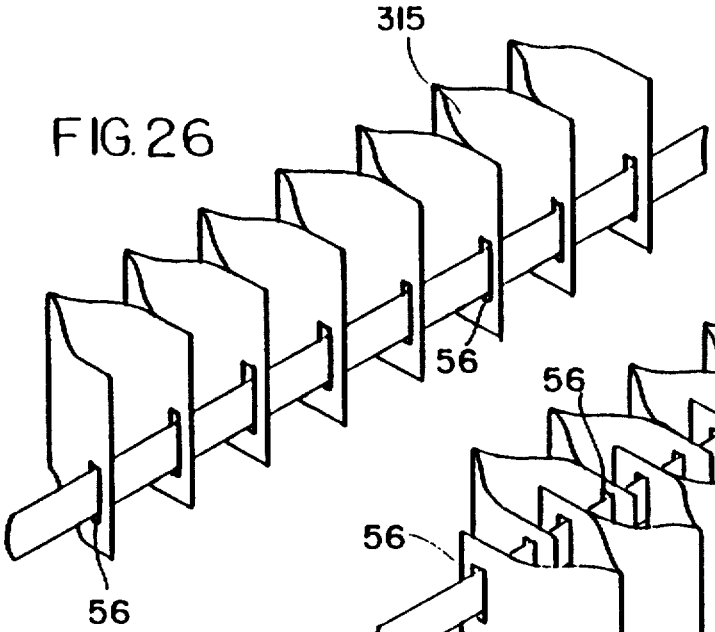
FIG. 27
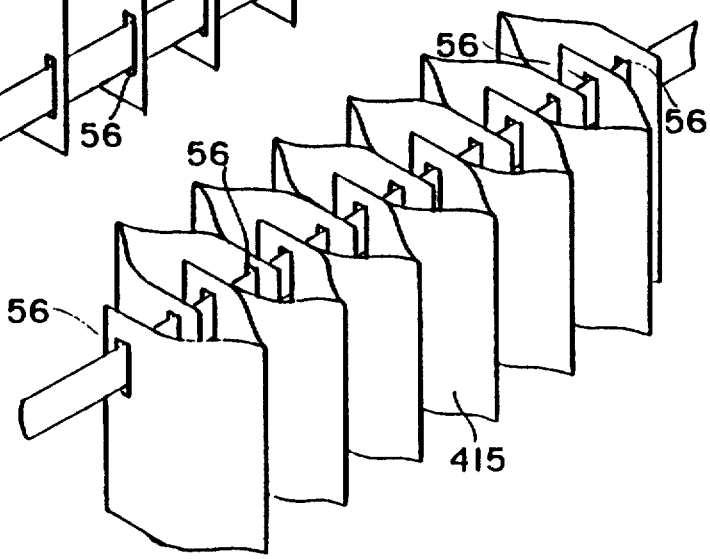

FIG. 28
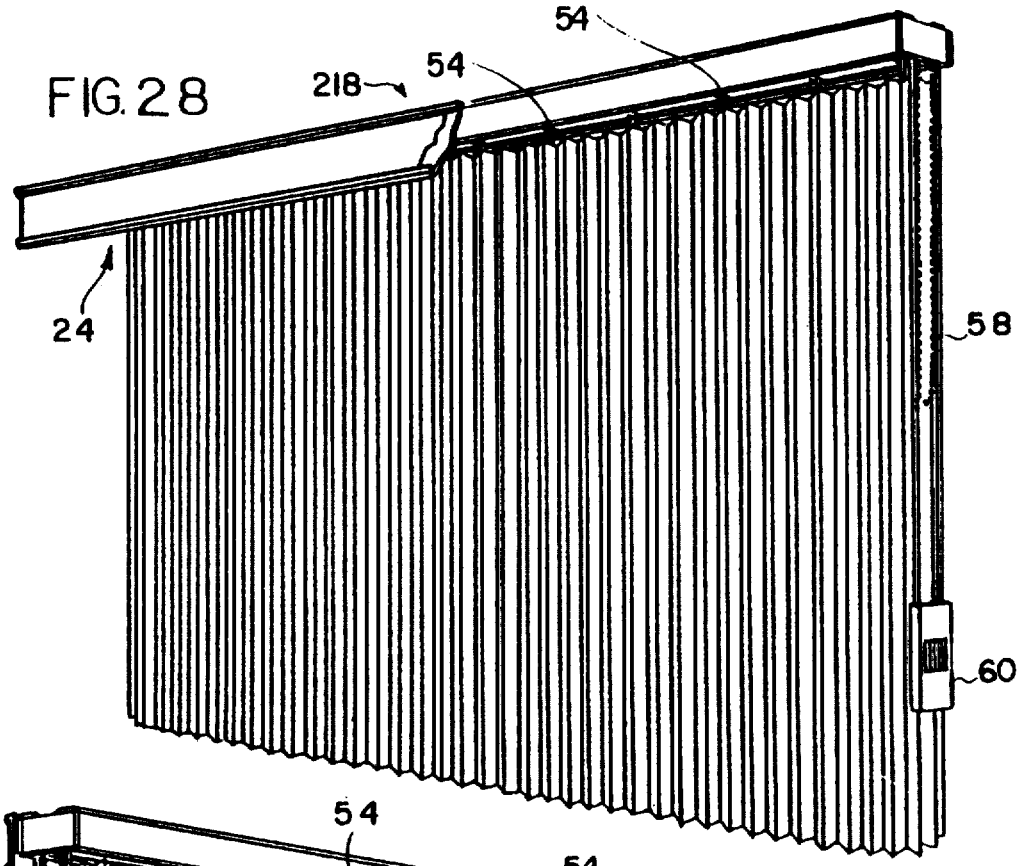
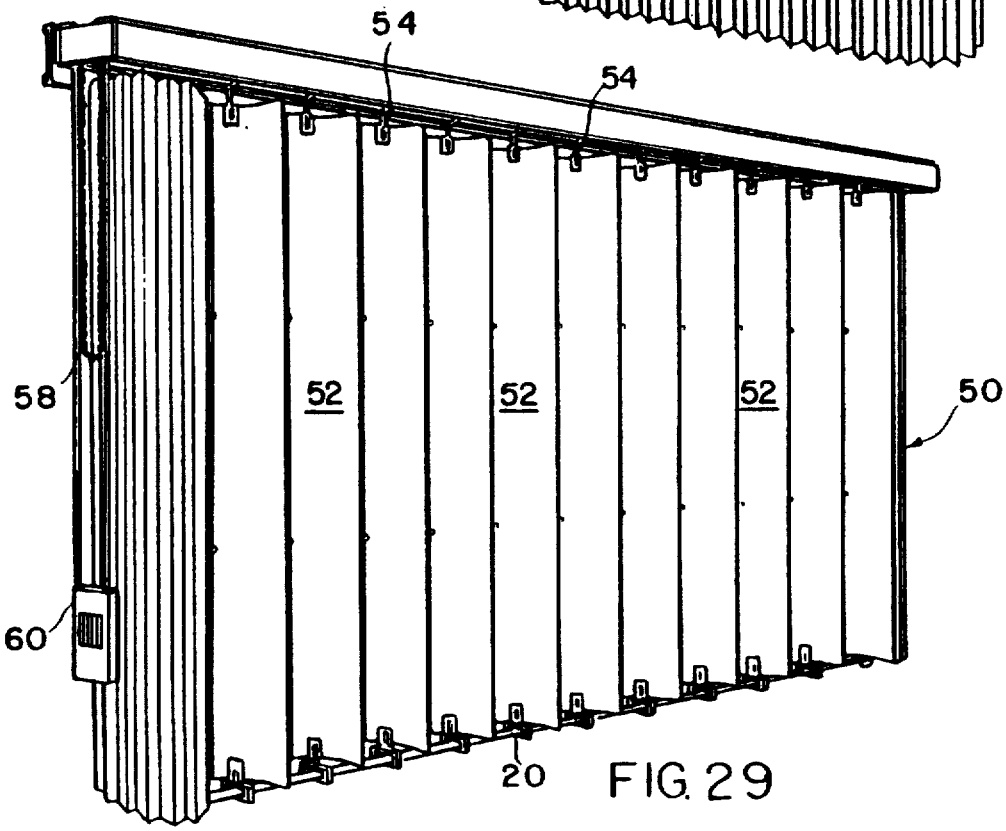
FIG. 29

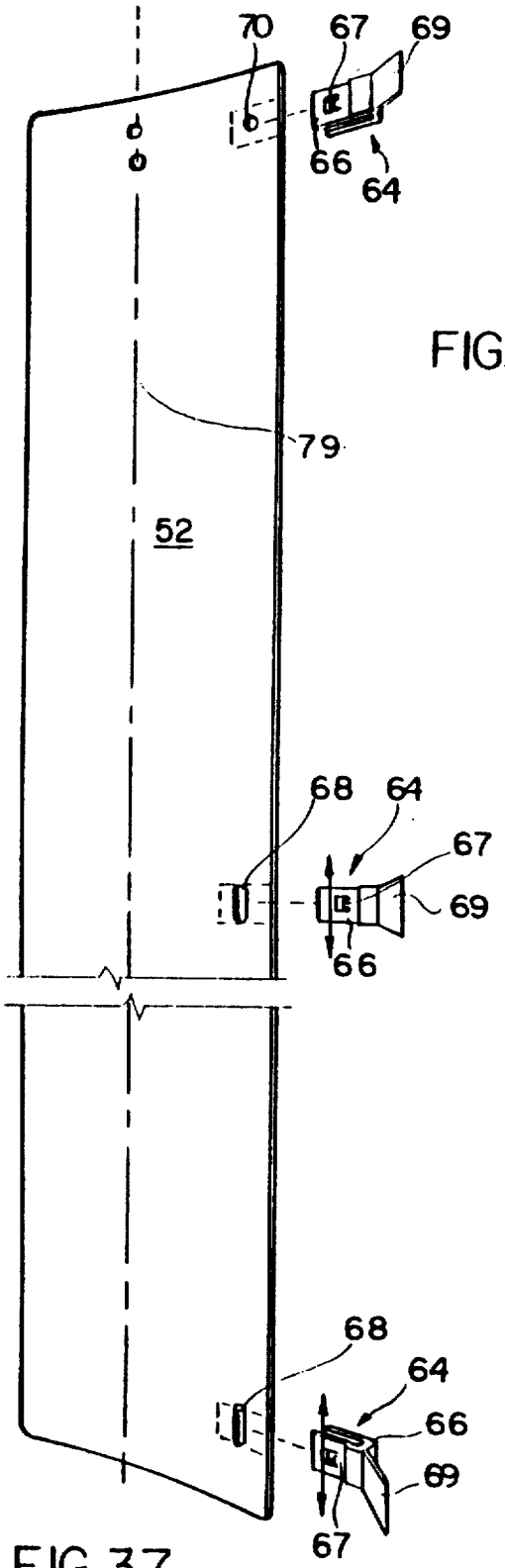
FIG. 37
FIG. 43
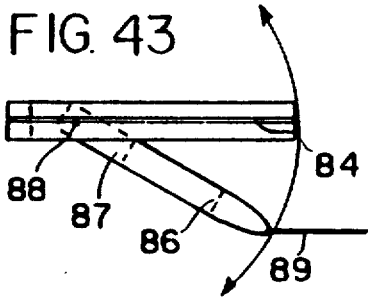
FIG. 44
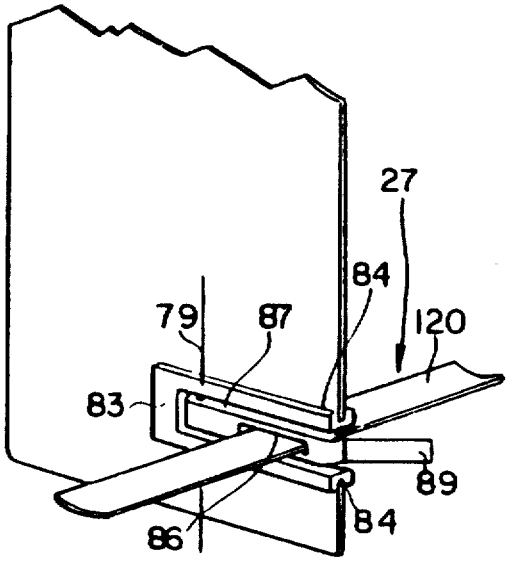
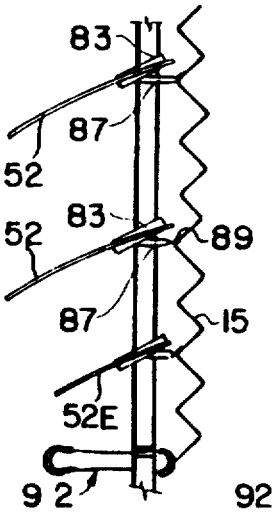
FIG. 45
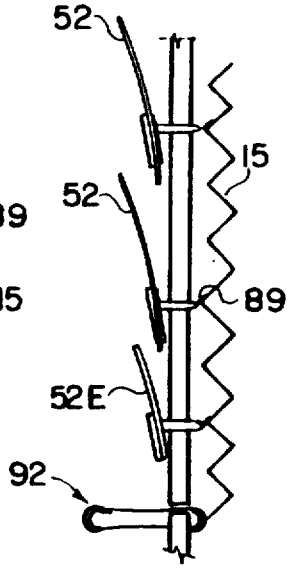
FIG. 46

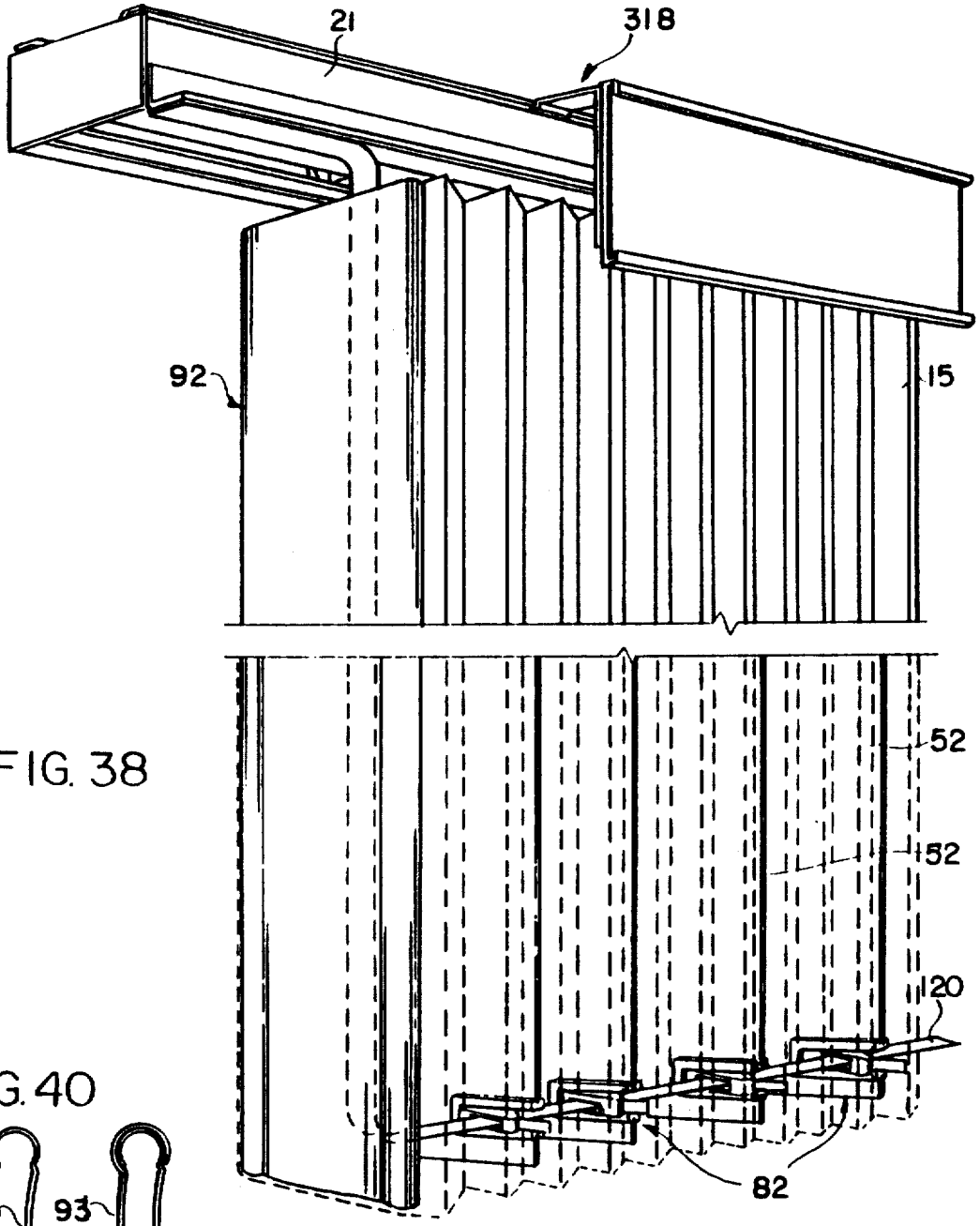
FIG. 38
FIG. 40
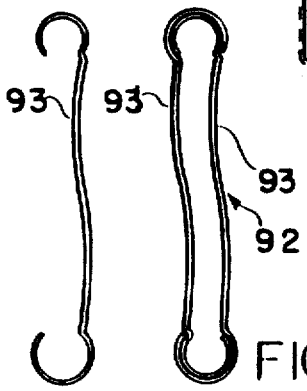
FIG. 39
FIG. 42
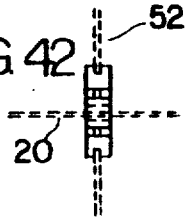
FIG. 41
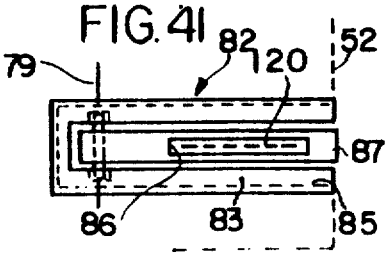

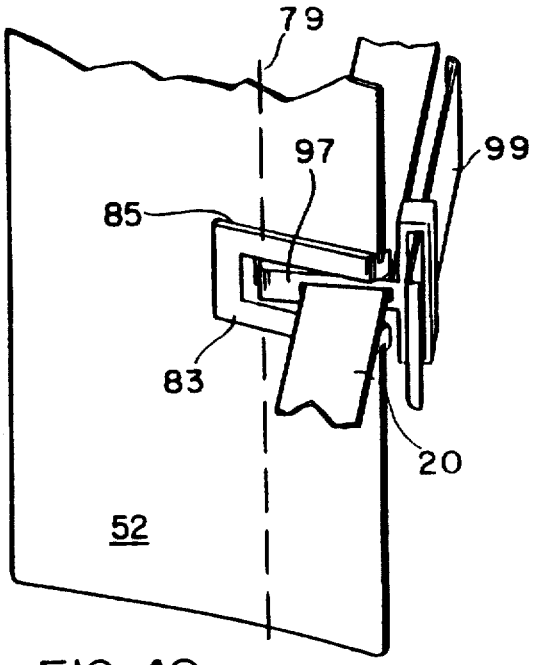
FIG. 49
FIG. 51
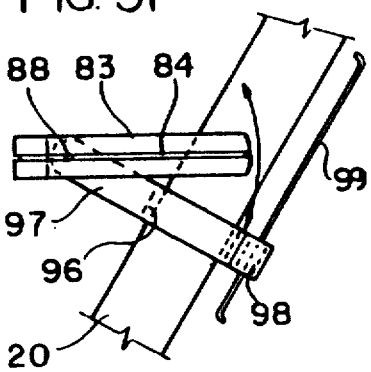
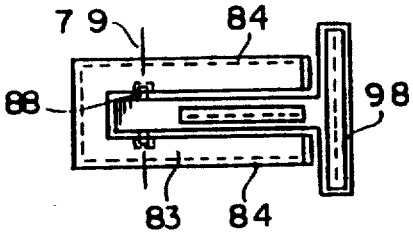
FIG. 50
FIG. 52
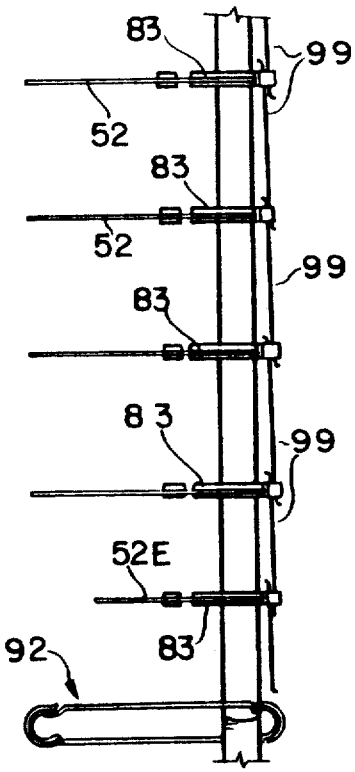
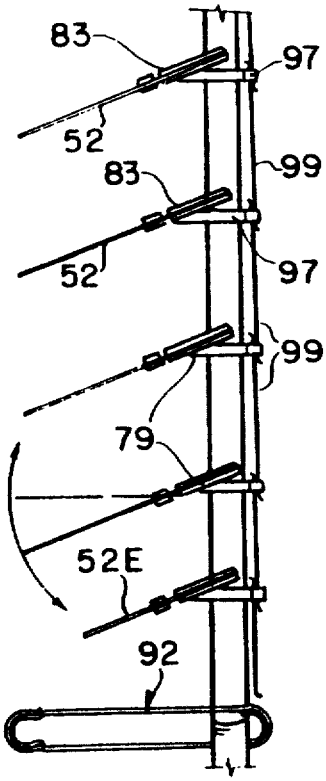
FIG. 53
FIG. 54
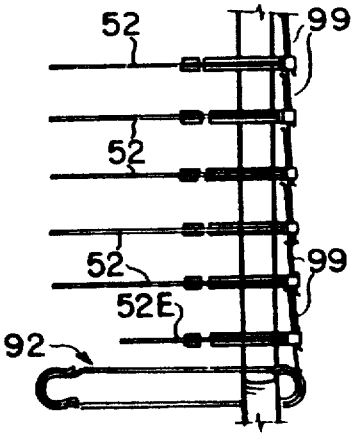

TAPE-SUPPORTED WINDOW COVER SYSTEM

1. BACKGROUND OF THE INVENTION

This invention relates generally to window cover systems, to window cover drapery systems using various cover materials such as pleated or non-pleated fabrics or slats or blinds and, typically, to vertical cover systems in which the sections of the cover such as the pleats of prepleated material or the blinds or slats are disposed vertically.

The term "window" cover is used here for convenience, but with the understanding that my invention can be used to cover other areas or openings, such as doorways. Also, for convenience frequent reference is made to pleated fabric window cover systems, but this reference is exemplary and not limiting, for as indicated above the invention is applicable to various materials, including non-pleated fabrics and blinds.

2. DESCRIPTION OF THE RELEVANT INDUSTRY

Over the past several years, pleated shade systems have become a popular form of window treatment. One version of a pleated shade system available from Verosol USA, Inc. of Pittsburgh, Pa., under the trademark RIDAU, utilizes a prepleated fabric with strong, permanently set pleats which pack very tightly. The Verosol fabric pleats are single pleats. Another version of prepleated fabric is a dual pleated "hollow" fabric recently introduced by the Window Fashion Division of Hunter Douglas, Inc. of Broomfield, Colo., under the trademark DUETTE. Graber, Inc. markets a CRYSTAL PLEAT brand, dual hollow pleated fabric window cover. A seamed pleated fabric cover is available from Verosol, USA, Inc. under the trademark FINALE.

Several of these pleated fabrics work very well in pleated shade systems because the pleats run horizontally and the regularity of the pleats is controlled by the weight of a board or other length of rigid material fastened to the bottom edge of the area of pleated fabric.

A major problem with use of the prepleated material when the material is oriented vertically is providing uniform hanging of the pleats. Because of the strongly set pleats, the material tends to behave like a tension spring. The pleats have a spring inherent bias toward the packed-together or closed state of the fabric. When used in a vertical drape, this spring force makes the material hang with uneven draping when the drape is closed (i.e. the open state of the pleated fabric) because the bottom portion of the material which is not mechanically constrained tends to draw together. Thus the pleats do not hang straight and the appearance is unacceptable.

An additional problem occurs when the drape is being traversed open (closed or packed state of the fabric) after being left in a closed position for a length of time. The pleats of the drape do not always pack consistently and tend to distort out of the plane of traverse of the drape. This makes it difficult to obtain a uniform pleating of the drape as it closes and requires hand adjustment of the individual pleats of the fabric.

Vertical blind systems are also popular window covers and share some of the same problems. It would be preferable to use the same string ladder spacing and confining system in a vertical blind that is used in horizontal blind. However, if a string ladder is used, the weight of the ladder itself tends to distort the shape of the overall blind, especially at the edges where the bottom portions of the edge slats tend to be pulled inward. Furthermore, when the vertical blind is traversed from a closed to an open position, the slats tend to distort out of the plane of traverse due to unevenness in the folding of the string ladder material between slats.

My two recent patents, U.S. Pat. No. 4,858,668, issued Aug. 22, 1989, entitled VERTICAL WINDOW COVERING SYSTEMS, and its continuation-in-part, U.S. Pat. No. 4,915,153, issued Apr. 10, 1990, also entitled VERTICAL WINDOW COVERING SYSTEMS, disclose vertical cover support systems which are especially adapted to overcome the above problems associated with vertically mounted draperies and blinds. The '668 and '153 patents are incorporated by reference. Referring to FIG. 1, in one preferred embodiment, the vertical covering support systems disclosed in these patents include an elongate mounting platform 2, which is adapted for easy traverse along the system track 1, and means 4 which extends through a slot in the bottom of the traverse track for mounting a vertical drapery edge stabilizer 3. The end of the window covering 5 is attached to the rigid edge stabilizer member 3, which in turn is rigidly mounted to the platform 2 by member 4 and is held by the platform in a rigid vertical orientation to thereby maintain the end of the drapery 5 or other covering in a precise vertical orientation. A cord tensioning arrangement 6 maintains the covering in the vertical plane of the system (the vertical plane extending downward from the traverse track 1). Preferably the platform 2 is elongate along the direction of the traverse track 1 and includes spaced wheels 7—7 which are captured between top and bottom rails of the track, thereby providing the combination of a stable horizontal mounting platform for the vertical edge stabilizer 3 and easy, finger-tip traversal along the track. Other features may include a torque release arrangement (not shown) for mounting the edge stabilizer to the platform 2 and allowing the edge stabilizer to pivot when a predetermined sideways force is applied, to prevent damage to the system.

Like all thing conceived by humans, the vertical covering support systems disclosed in my above patents are not perfect. Specifically, although the systems are quite effective, it is desirable to have a system of even greater simplicity and lighter weight which provides the stability, ease of traverse and other improved characteristics described in my above-described patents.

3. SUMMARY OF THE INVENTION

In one aspect, my invention is embodied in a window cover system which incorporates a longitudinally rigid, transversely flexible support tape for providing full displacement and automatic alignment, typically without rigid, heavy support structures such as edge stabilizers.

In another non-exhaustive aspect, my invention is embodied in a window covering system, which comprises an elongated traverse track; a plurality of trolleys mounted on the track for traversing along the track; a cover attached to the trolleys and having at least one free end supported by the trolleys for traversing along the track; a longitudinally rigid, transversely flexible support tape routed along the cover in the general direction of traverse and supporting the cover; and tape containment means surrounding the tape for securing the tape against transverse displacement. In one preferred embodiment, the tape is routed and contained along the bottom of the cover and the free end of the cover and is routed and releasably contained along the track at the free end of the cover, thereby enabling the tape to push and pull the cover and provide full displacement of the tape, and maintaining the desired vertical orientation of the free end.

In one alternative embodiment, the cover is free to traverse at both ends. Preferably, the tape is routed along the track outside both free ends of the cover, along both free ends, and along the cover (typically at the bottom hereof) in the direction of traverse.

In another preferred embodiment, the movable cover is attached to a vertical edge housing containing a sprocket and two tapes are routed through the cover, one at the top and the other at the bottom, and over the sprocket. The sprocket maintains uniform, equal velocity of the tapes, thereby maintaining the desired vertical orientation of the housing and the cover as the cover is traversed between open and closed conditions.

In yet other non-exhaustive aspects, my invention is embodied in and applicable to flat and curved support tapes, to drape covers, to blind covers and, to combinations thereof.

Coved tapes are preferred because of the great push and pull energy which they provide, and in particular because of the push energy. This effects both opening and closing the cover and facilitates positive full displacement of the tape and the associated cover and maintaining the desired vertical orientation at all times, including during traversal.

4. BRIEF DESCRIPTION OF THE DRAWING

The above and other aspects, features and advantages of my invention are described below with respect to the drawing, in which:

FIG. 1 is a schematic front elevation view depicting a vertical cover system disclosed in my incorporated patents, U.S. Pat. No. 4,858,668 and 4,915,153.

FIGS. 3 and 4 are front and rear perspective views, respectively, of a vertical hollow pleat embodiment of my invention.

FIG. 5 is a partial perspective view depicting a flat tape version of the hollow vertical pleat drapery embodiment of my present invention.

FIG. 6 is a horizontal sectional view taken along line 6—6 in FIG. 5.

FIGS. 7 and 9 are, respectively, a partial perspective view and a partial front elevation view which depict a curved tape version of the hollow vertical pleat drapery embodiment of my present invention.

FIG. 8 is a horizontal sectional view taken along line 8—8 in FIG. 7.

FIGS. 24 through 27 depict the use of my tape support in conjunction with vertical drapery systems which incorporate various pleated materials.

FIGS. 28, 29 and 30 are, respectively, a front perspective view, a rear perspective view and a relatively enlarged, partial front perspective view, partially cut away, all of an embodiment in which a tape support system and a vertical pleated silhouette drape are combined with a conventional vertical blind system to form a vertical pleated silhouette blind system.

Figures 31, 32, 33, 34, 35, 36:
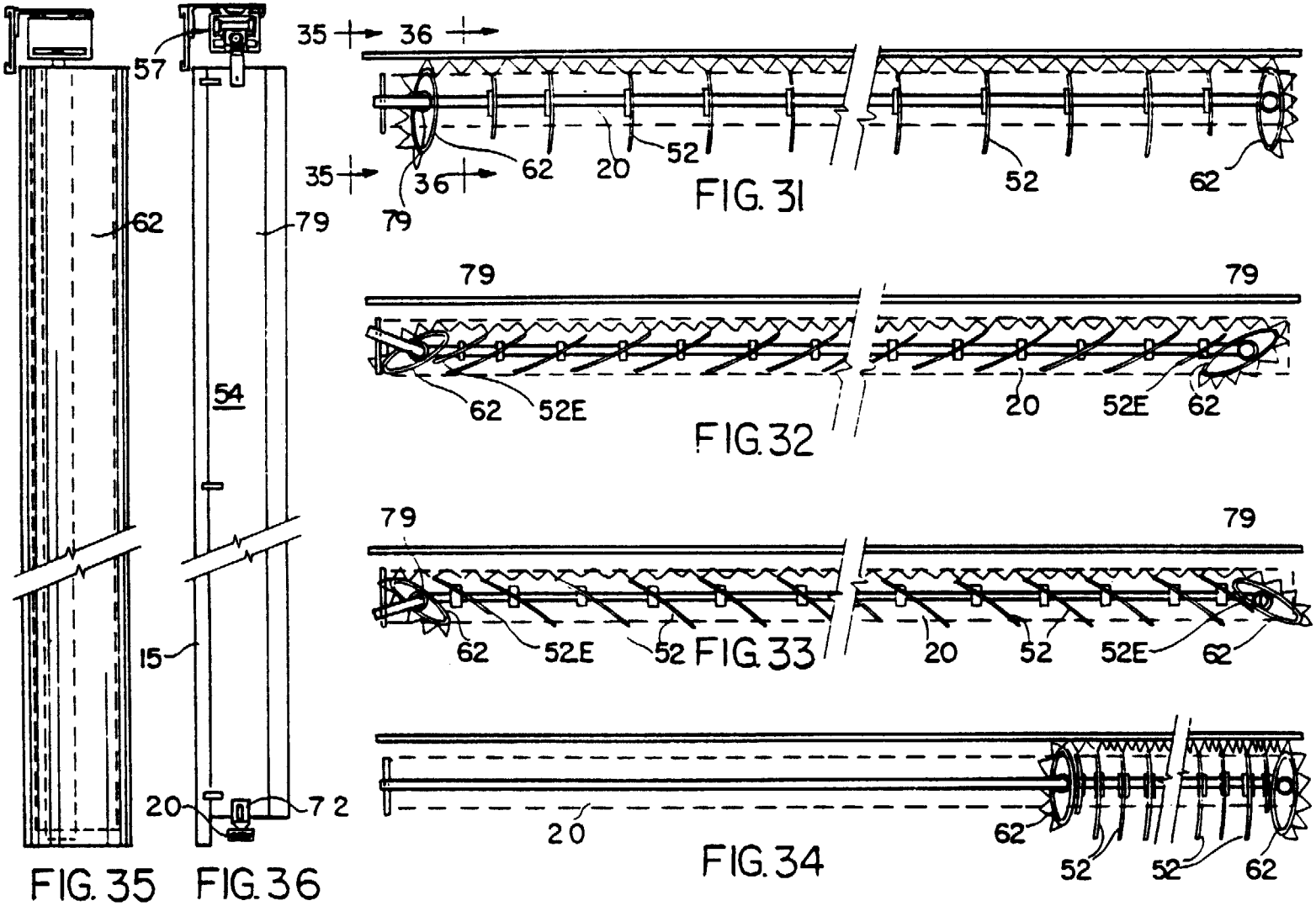
FIGS. 31 through 34 are top plan views of the combined vertical pleated silhouette blind system shown in FIG. 28, with the traverse track removed, showing the operation of the system.

FIGS. 35 and 36 are vertical sections (FIG. 35 is essentially an end view) taken along lines 35—35 and 36—36 in FIG. 31.

Figure 20:
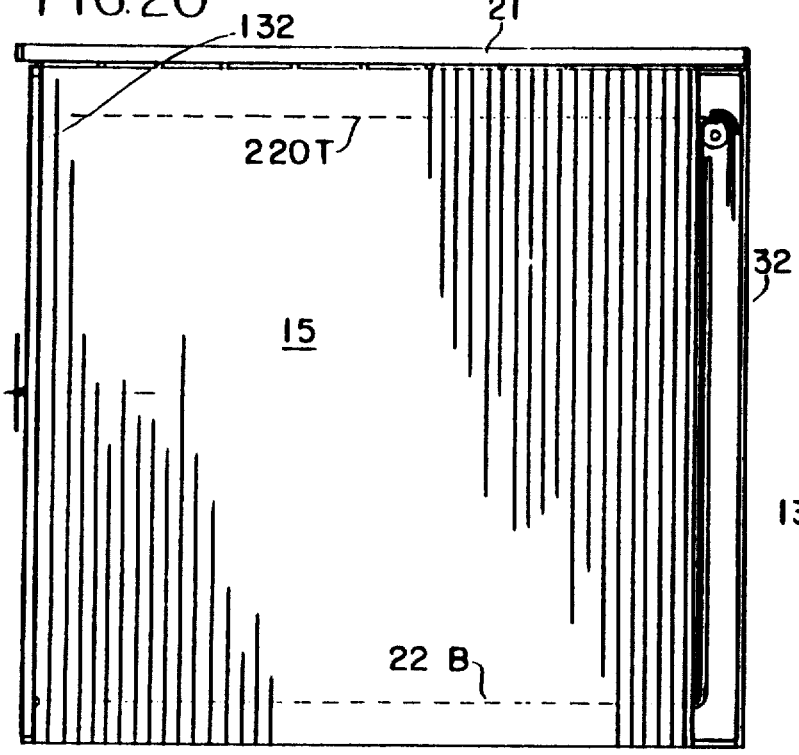
FIG. 20 is a front elevational view depicting the cover open condition of an alternative, master-sleigh socket-controlled arrangement.

FIG. 37 depicts a representative slat from the system of FIG. 20 and associated mounting details.

Figure 30:
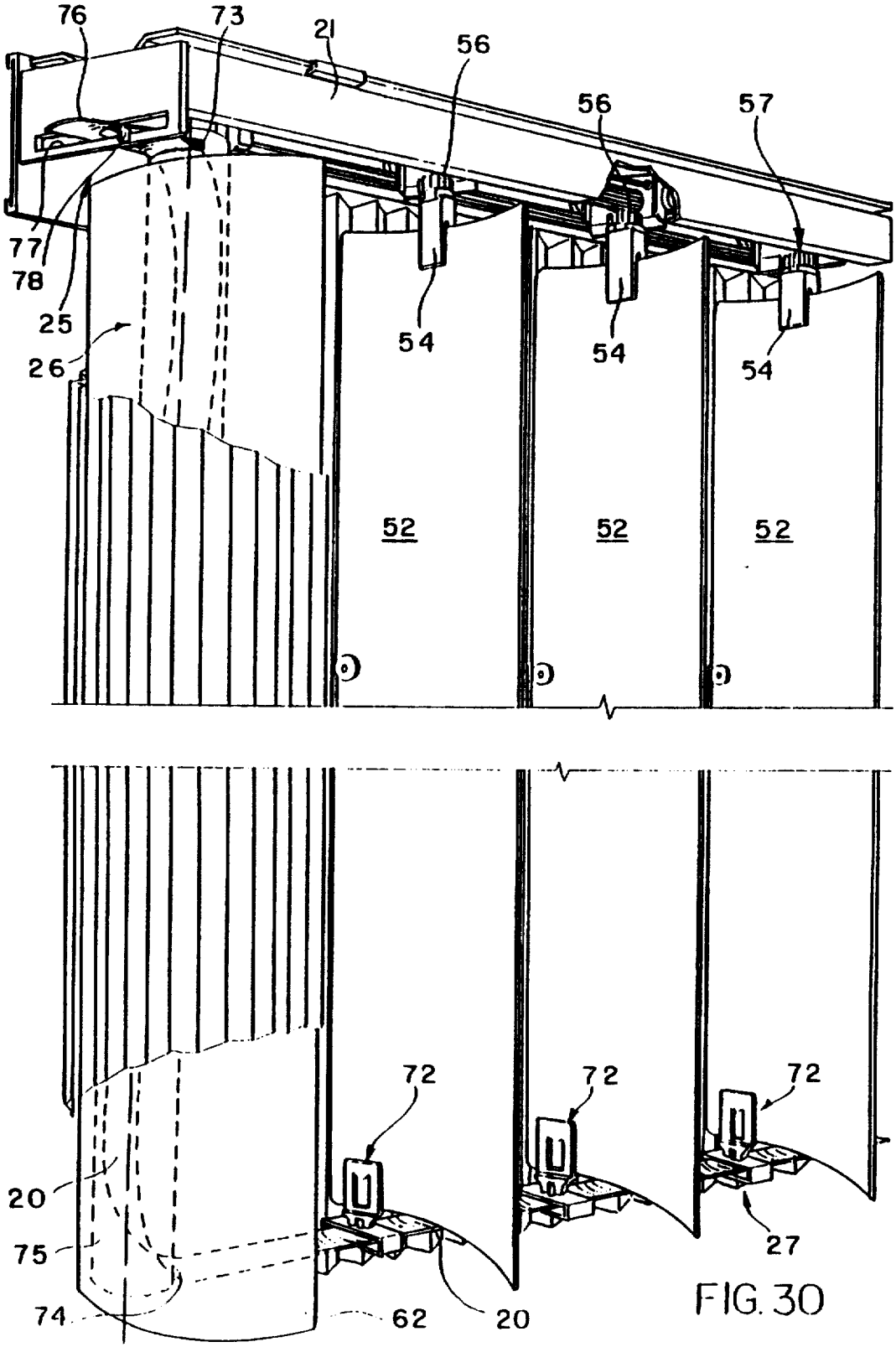

FIG. 38 is a partial front elevation view, partially cut away, of an a alternative embodiment of the combined vertical pleated silhouette blind system shown in FIG. 30, which incorporates a pivotal-link tape-support arrangement for routing the tape through the blinds.

FIGS. 39 and 40 are horizontal sectional views of an end stiffener useful in the system of FIG. 38.

FIGS. 41 and 42 are side and end elevational views of a pivotal link support member.

FIG. 43 is a top view of the member of FIG. 41.

FIG. 44 is a partial perspective view of a slat illustrating the mounting relationship of the slat, the pivotal link support member and the tape.

FIGS. 45 and 46 are horizontal views of different open and closed conditions of the system of FIG. 38, illustrating the pivotal operation of the pivotal link support members during opening and closing of the Off-center-mounted slats.

Figure 47:
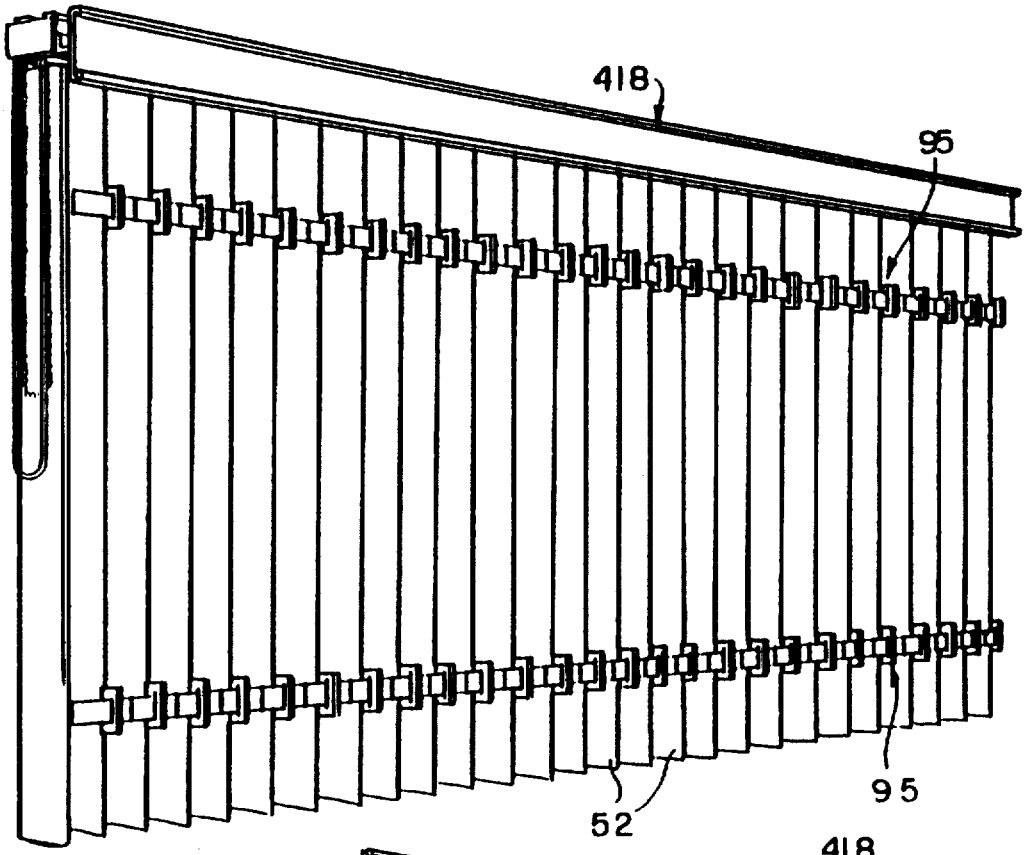
Figure 48:
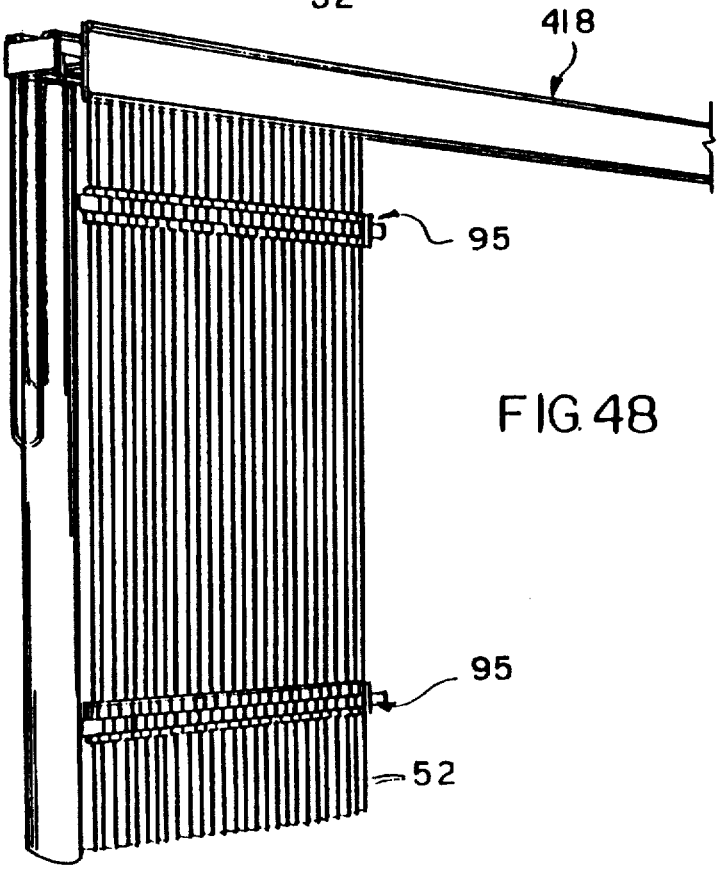

FIGS. 47 and 48 are front perspective views illustrating the closed and open condition of a vertical blind which incorporates a combination tape and telescopic link support system.

FIG. 49 is a partial perspective view of a slat of FIG. 47 and 48, illustrating the mounting relationships among the slat, the pivotal support member, the tape and the link(s).

FIG. 50 is a side elevation view of one of the pivotal support members of FIG. 47, illustrating the mounting relationships among the member, the tape and the link(s).

FIG. 51 is a top view of the pivotal support member of FIG. 50.

FIGS. 52, 53 and 54 are partial horizontal views (in the manner of horizontal section views) of different open and closed conditions of the system of FIGS. 47 and 48, illustrating: both the blind system and the slats in an open condition (FIG. 54); the blind system closed (extended) and the slats open (FIG. 52); and both the blind system and the slats closed (FIG. 53).

5. DETAILED DESCRIPTION OF THE PREFERRED EMBODIMENT(S)

a) Overview of Tape-Supported Window Cover System 18

Figure 2:
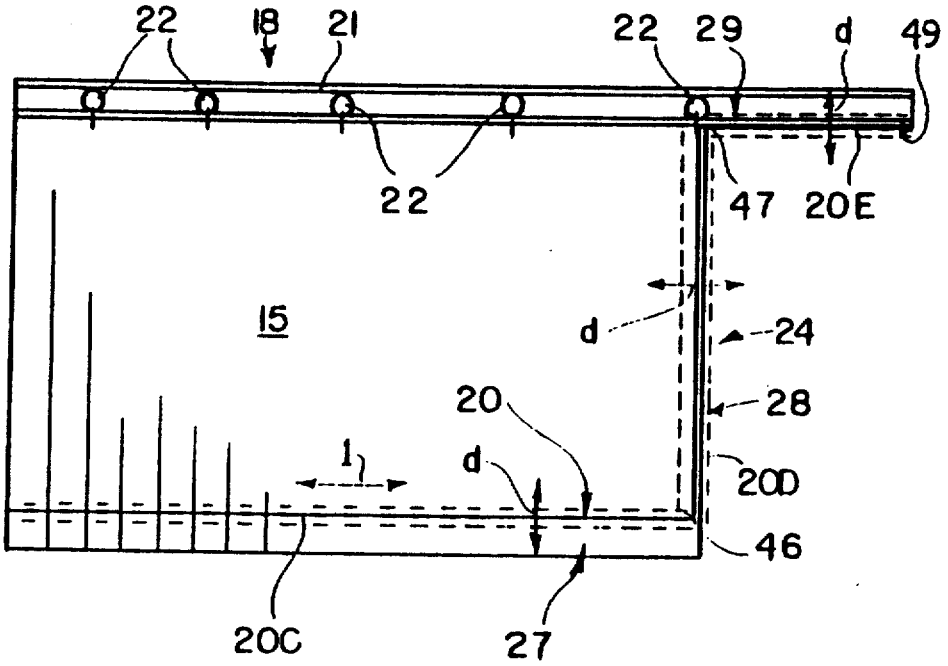
FIG. 2 is a schematic front elevation view which depicts a vertical cover system incorporating features of my present invention.
Figure 1:
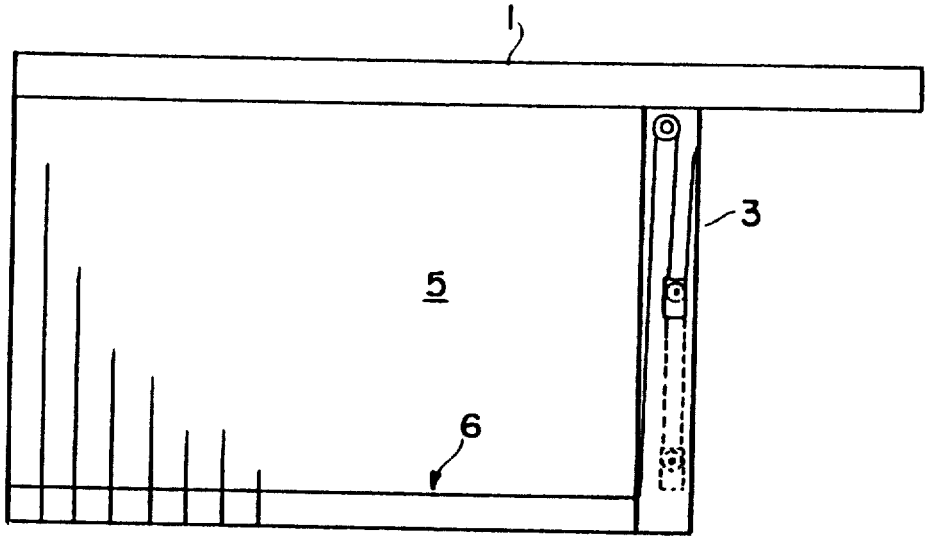
FIG. 1 PRIOR ART
Figure 1:
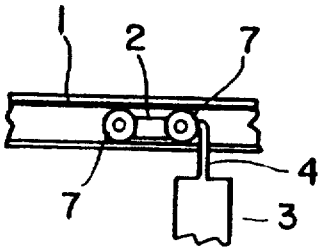
FIG. 1 PRIOR ART

FIG. 2 is a schematic depiction of certain basic features of my new tape-based PLEATOUETTE window cover system, which is an improvement of the vertical window cover system disclosed in my above referenced '668 and '153 patents. FIG. 2 illustrates a single traversing system 18 in which the left end of the window cover 15 (such as a single pleat or hollow pleat drape) is immobile and the right end of the window cover is free to bidirectionally traverse between open and closed positions. (Please note, when the drapery or other cover is open, exposing the window, the material itself is closed (bunched); when the cover is closed, covering the window, the material itself is open. A member such as a flat tape 20 which is longitudinally rigid (along direction 1) and transversely flexible (along direction d) can replace a number of components of the systems disclosed in the '668 and '153 patents. These include the cord alignment system 6, FIG. 1, and the edge stabilizer system, including the horizontal platform 2 and the spaced support wheels 7—7 or other elongate support captured at spaced points by the traverse track, and the rigidly mounted edge stabilizer member 3. The exemplary system 18 includes means such as standard trolleys 22 for mounting the cover 15 at spaced intervals for traversal along track 21 and tape containment means 24 which constrains movement of the flexible tape in the transverse direction d.

In the single traversing embodiment depicted in FIG. 2, the overall tape containment means 24 comprises three constituent containment means or sections 27, 28, and 29 for the three sections 20C, 20D, and 20E of the S-shaped path of the tape. Each of the containment means performs at least two functions. The illustrated lower horizontal containment means 27 comprises support means such as horizontal slots 31—31 (see FIGS. 24 and 25) formed in the drapery material or in tabs attached to the material for capturing and routing the lower horizontal tape section 20C through the drape generally in the direction of traverse. Typically, the slots can be spaced apart several inches, which is the maximum spacing between adjacent pleats. In capturing the tape 20, the containment means 27 also contains the tape. The contained tape maintains the drape or other covering 15 in the desired vertical plane, extending downward from the traverse track 21. That is, the tape performs the alignment function of the cord alignment system 6.

The containment means 28 depicted in FIG. 2 comprises a vertical, elongated hollow housing member or stiffener 32, FIG. 5, preferably of lightweight material such as plastic, which is attached proximate the free (right) end of the covering material. The containment means 28 routes the vertical tape section 20D between the bends 46 and 47 which separate lower horizontal section 20C, vertical section 20D and upper horizontal section 20E, and contains the vertical section 20D of the tape. This containment means maintains the traversing (free) end of the covering material 15 in an accurate vertical orientation and cooperates with the containment means 27 to maintain the alignment of the covering material 15 within the desired plane extending vertically downward from the track 21.

Containment means 29 releasably contains the upper horizontal section 20E of the tape 20 along the traverse track 21. In a preferred embodiment, the upper horizontal containment means 29 comprises suitable means for providing a force of sufficient magnitude to normally hold the tape 20 flat against the traverse track 21, but small enough that the tape is easily released. Preferably, this containment means is adhesive magnet tapes or adhesive magnet strips 33—33, FIG. 5, which are mounted along the bottom of the track 21 for magnetically holding the tape 20 adjacent the track, for releasing the tape when the window covering is traversed rightward, that is toward or into a closed condition, and for re-engaging the tape when the window covering is moved leftward, toward or into an open condition. The adhesive magnets 33—33 may be a commercially available type which are marketed for mounting on appliances such as refrigerators for displaying or attaching messages.

Referring further to FIG. 2, the longitudinally relatively rigid, transversely relatively flexible tape 20 and the containment means 24, especially the releasable containment means 29, permit easy bidirectional traverse and accurate, "100% displacement" between the horizontal sections 20C and 20E of the tape. A length of the horizontal section 20C or 20E of the tape which is adjacent the bend 46 or 47 and is equal in length to the distance traveled by the traversing end of the window covering 15 is accurately and fully transferred from one horizontal section 20C or 20E to the other section 20E or 20C. Thus, as the window covering 15 is traversed to the right (or to the left) a given distance/dimension, the length of upper horizontal tape section 20E decreases (increases) and the length of the bottom horizontal section 20C increases (decreases), both by that dimension. This accurate and full transfer or displacement maintains the accurate vertical orientation of the tape 20D, and, thus, of the free end of the window covering material, and precisely preserves the containment and alignment functions of the containment means 27.

In addition, unlike cord systems, which are able only to pull a window covering, because of its longitudinal rigidity, the tape 20 both pushes and pulls the window cover. The containment 24 means keeps the tape from "exploding" like a speedometer cable or a tape measure, that is, from displacing transversely, and enables the push and pull power. In combination, the tape and containment means provide light weight, simple, easy traversing construction without components such as the cord alignment system 6, FIG. 1, and the edge stabilizer system, FIG. 1 (the elongated horizontal platform 2 with spaced support points 7—7 captured by the traverse track 1 and the rigid, rigidly mounted elongated edge stabilizer member 3).

Preferably the tape 20 and the other tapes discussed here are metal tapes and, in fact, steel tapes of the type used in retractable tape measures have been used.

To date, and referring for example to FIGS. 5 and 7, I have used flat tapes 20 (tapes of straight or flat profile in the transverse plane perpendicular to the longitudinal direction, 1; see FIG. 5), as well as tapes 120 which are coved (of concave transverse profile; see FIG. 7). The coved tapes (also called cupped or concave tapes) are preferred in part because they bend more easily than flat tapes and with less resistance to movement around bends when the cove faces radially inward at the bend. Coved tapes also provide great push and pull energy. This effects both opening and closing the cover and facilitates positive full displacement of the tape and the associated cover and maintaining the desired vertical orientation at all times, including during traversal.

For example, I have used steel tapes ¼" (inches) to 1" in width by 0.006" to 0.010" thick to support hollow pleat DUETTE window covers about 96" long by 120" wide (or greater).

b) Tape-Supported Hollow Pleat (DUETTE) System 118

FIGS. 3-8 depict various embodiments of a hollow pleat window cover system constructed in accordance with my invention. FIGS. 3 and 4 illustrate a dual traversing mounting arrangement 118 in which both ends of the prepleated hollow pleat drape 115 are free to traverse. Illustratively, the tape 20 is flat and the ends of the window cover are attached to housing or stiffening members 32. As shown in FIG. 4, in this embodiment, the tape containment means 24 comprises five sections 25-29. Containment means section 25 is the equivalent of previously discussed section 29. Both comprise the magnet strips 33—33 which are attached to the bottom side of the track 21 on opposite sides of the window covering 115. Containment means section 26 is the equivalent of section 28, and comprises the hollow housing members 32. Containment section 27 comprises horizontal slots 31—31 (FIG. 24) formed in the hollow pleat fabric, as described previously. The containment means 27 functions as described previously in cooperation with the left and right containment means 26 and 28 to provide full displacement between tape sections 20A and 20E, respectively, and the horizontal tape section 20C, when the left or right end of the window covering 115 is traversed.

As alluded to previously regarding the FIG. 2 embodiment, the metal tape push and pull and the full displacement keeps the window cover such as 15 and 115, 90° square when the cover is in repose (stationary), yet effects flexible support for the window cover such that the window covering can be displaced laterally and in and out of the vertical plane without damage.

FIG. 5 also depicts a standard trolley 22 of the type which may be used in the various embodiments of my invention. The trolley 22 comprises a roller carriage portion 36 which includes a pair of wheels spaced apart transversely across the width of the track 21, and a hanger 37 which extends vertically from the carriage 36 through the bottom slot 38 in the generally C-shaped track 21 cross-section, and attaches to a stabilizing strip 39 (not shown) mounted on the window covering material 118. Note, typically the trolley 22 need not be elongated, and need not comprise longitudinally spaced support points such as wheels.

FIGS. 5 and 6 also depict various details of the system 118 including means 41 such as set screws which secure the opposite ends of the dual traversing tape to the bottom side of the traverse track 21. Strip magnets 33—33 are adhered to the bottom side of the traverse track 21 on opposite sides of the tape. A tape brake arrangement 42 comprises a magnetic or non-magnetic brake pad 43, the position and associated braking action of which is controlled by a thumb screw 44 extending through the sidewall of the housing 32.

As shown in FIG. 6, the end of the fabric 15 is attached by attachment means such as a snap-on to the housing 32. Also, the housing 32 conveniently has a rectangular bore 48 to accommodate the flat tape 20.

FIGS. 7 and 8 depict relevant details of a version of the hollow pleat system 118 which incorporates a curved tape 120. As mentioned previously, the concave tape 120 is oriented with the cup facing radially inward at the bottom and top turns such as 46 and 47. To accomplish this, the tape is rotated or twisted 180° within the hollow member or stiffener 132 and that member preferably has an internal passageway or bore 148 of circular cross-section to permit the tape to continuously reorient without obstruction during traversing movement.

Figure 9:
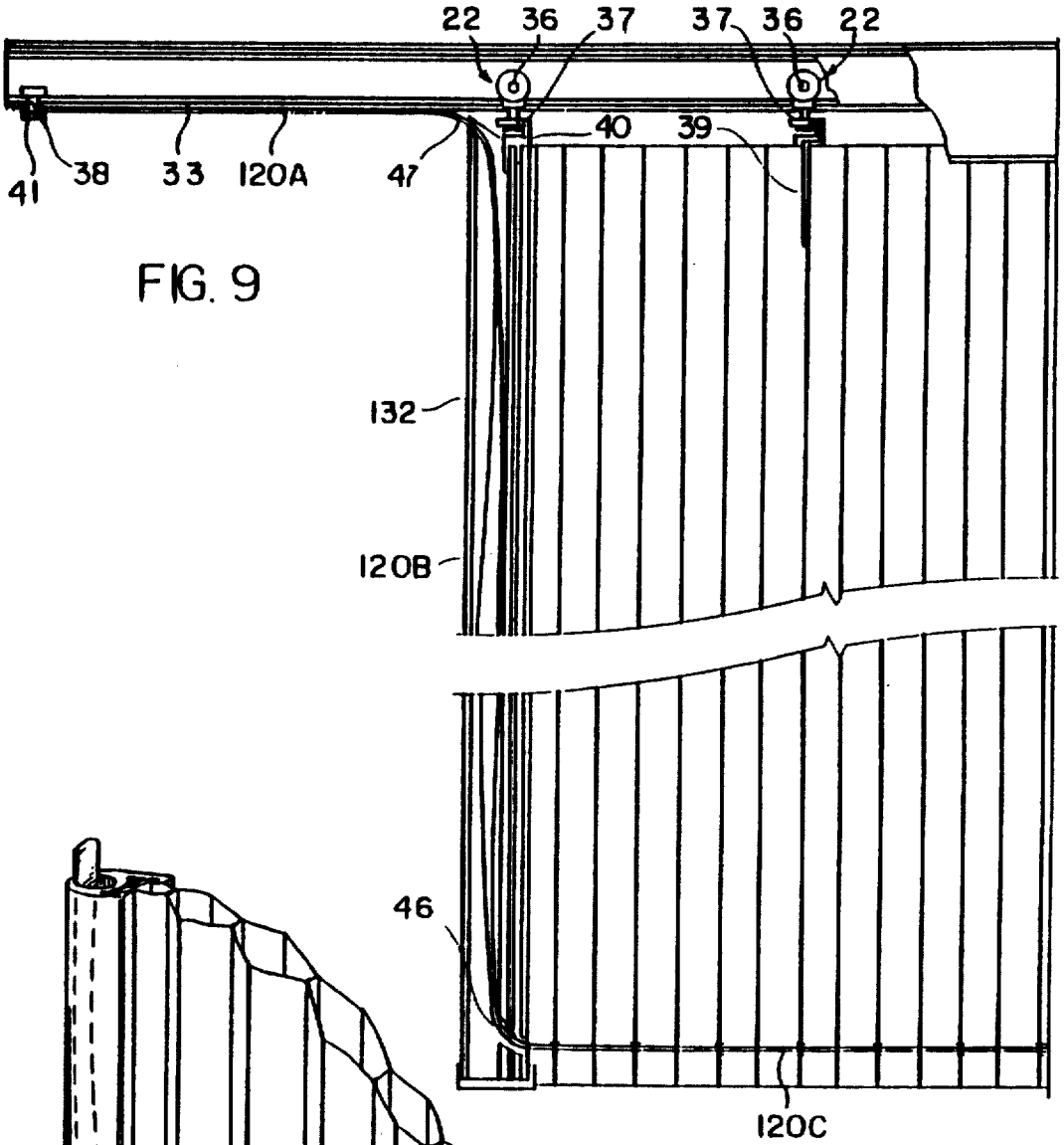

FIG. 9 illustrates additional details of the construction of the trolleys 22. The trolleys 22 which support the intermediate sections of the cover 15 are constructed as described previously. The end trolley 22 preferably includes or is mounted to a clip 40 which is mounted over the upper end of the housing sidewall. Please note, as illustrated in FIG. 9, end trolley 22 need only support the vertical edge housing member 32 or 132 for traversing along the traverse track 21. Unlike the vertical edge stabilizer arrangement in my incorporated patents, it is unnecessary for end trolley 22 to provide a stable horizontal platform or to rigidly orient a rigid edge stabilizer member to achieve the desired stable vertical orientation. As discussed above, the tape and the tape containment means perform these functions.

Figure 10:
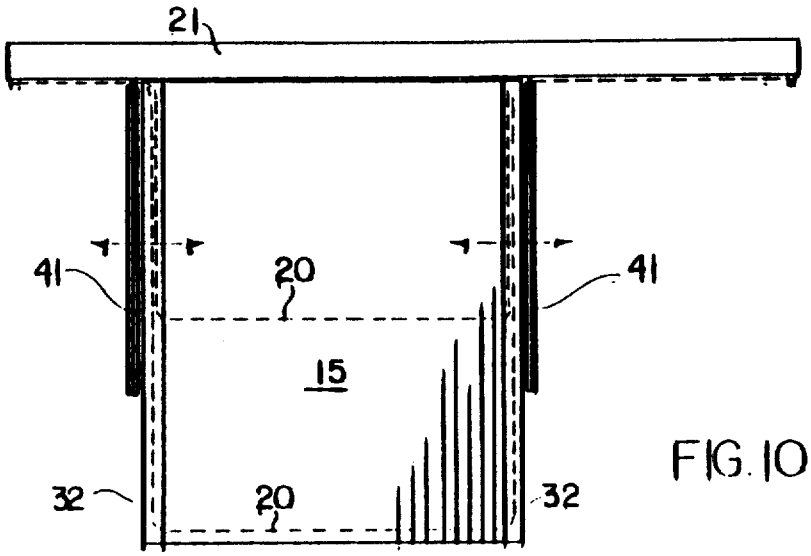
FIGS. 10, 11 and 12 are front elevation views showing additional features and other embodiments of my present invention.
Figure 11:
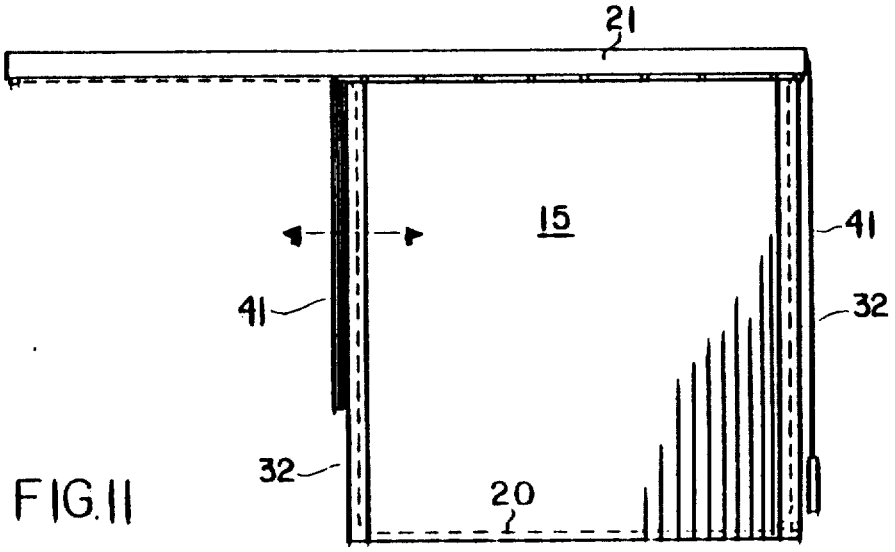
Figure 12:
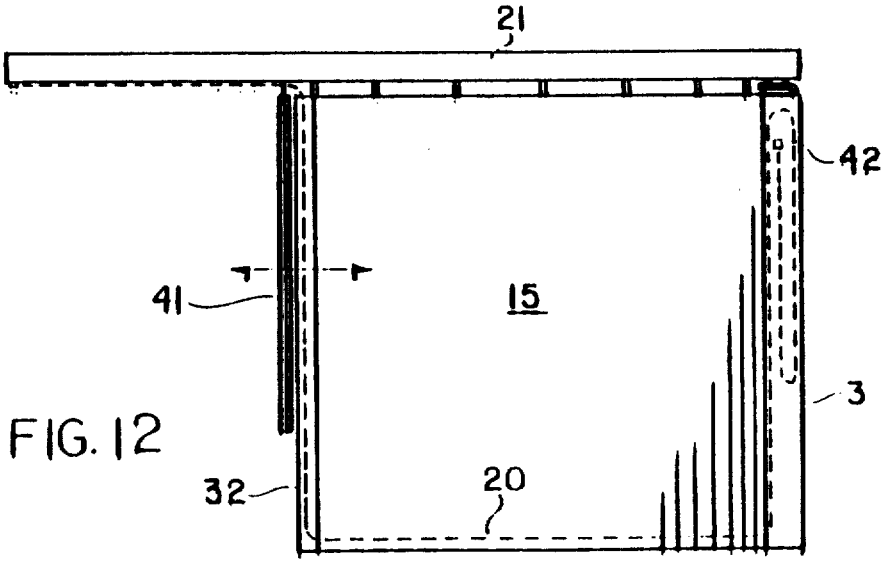

FIGS. 10, 11 and 12 disclose additional details and embodiments of the cover systems such as 18 and 118 and the systems described subsequently. Specifically, FIG. 10 depicts a dual traversing arrangement which uses separate top and bottom tapes 20 (or 120 or 220). Each tape comprises five sections 25-29. This two-tape system provides additional stabilization of the drape 15 intermediate the top and the stabilized bottom. Wands 41 are used for opening and closing the two free ends of the cover. The drape depicted in FIG. 11 is fixed at the right end and incorporates wand 41 for traversing the left end. Finally FIG. 12 depicts a dual traversing system in which the tape 20 (120) is coiled within the right side upright 3 of the type depicted in prior art FIG. 1 and is secured at its end within the upright, for example by a peg or screw 42. The tape coils and uncoils during traversal of the right upright 32 relative to the left upright 32, which is also free to traverse. Alternatively, of course, one of the uprights could be stationary.

Figure 23:
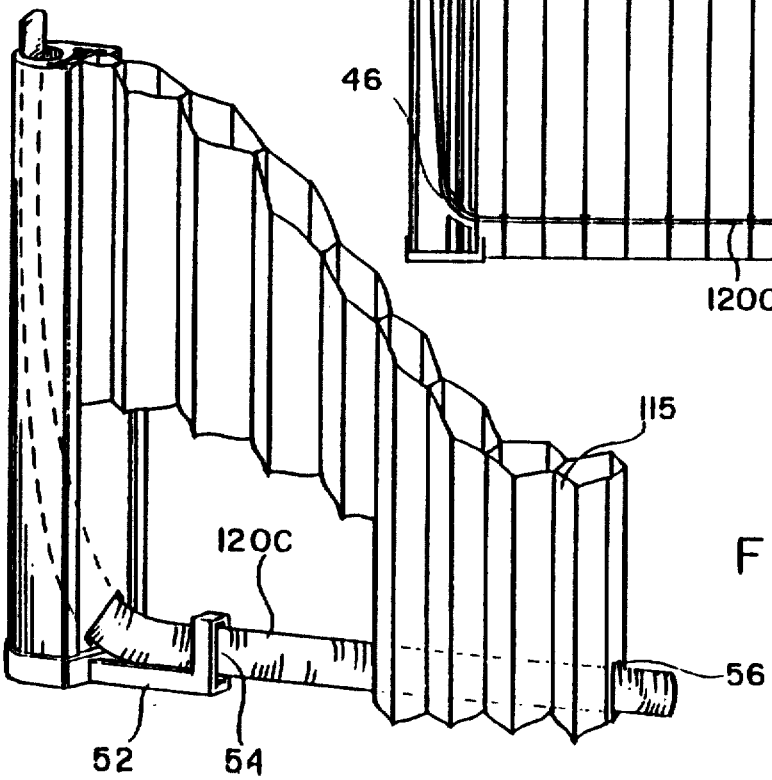
FIG. 23 depicts an embodiment in which, in the section routed through the drapery material, the tape is oriented on edge (vertically).

FIG. 23 illustrates an alternative tape mounting arrangement in which the tape is held on edge, vertically, by the containment means 27, for example by a bracket or tape guide 52 mounted to the bottom of the housing 132 and having a vertical slot 54 therein, and by vertical slots 56-56 in the fabric. This embodiment is particularly useful for covers having relatively narrow pleats. Alternatively, in such situations I have used a relatively narrow, plural ply (plural layer) tape or a relatively thick narrow tape.

c) Sprocket-Controlled, Tape-Support Cover System 8

FIGS. 13 through 22 depict an embodiment 8 of my tape-supported cover system which uses top and bottom tapes 220T and 220B and a pair of idler sprockets 9—9 which ensure that both tapes are displaced in unison at the same velocity. This maintains the accurate vertical orientation of the drape support uprights or housings 32/132/232 and the covering drape 15 which is attached to the uprights.

Figure 14:
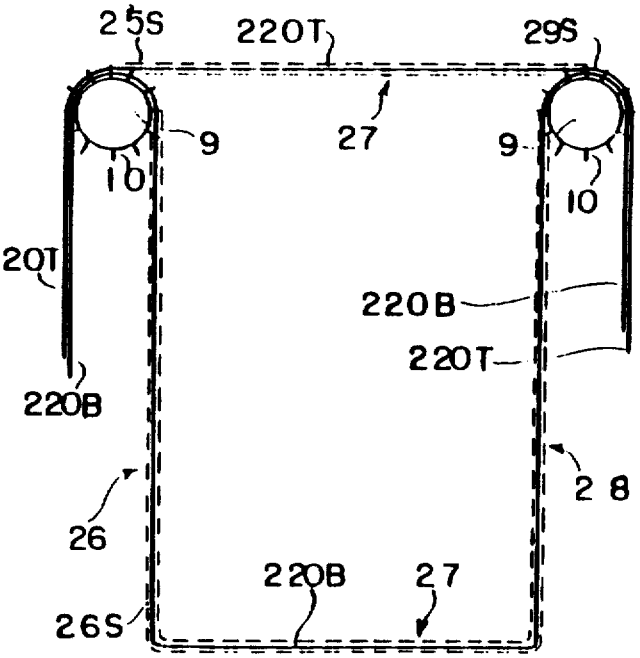
FIG. 14 is a simplified schematic depiction of the sprocket-timed dual tape support system used in the cover system of FIG. 13.

As shown in particular in FIG. 14, one sprocket 9 is mounted for rotation in the top interior of each housing 32. The bottom tape 220B forms a generally U-configuration which bends around the sprockets at each end, with an overhanging section at each end. This tape is contained by: left side vertical tape containment section 26 (channel 12 defined between the medial side wall of upright 32 and a spaced upright member 13); horizontal drape containment section 27 (drapery slots 31—31); and right side vertical tape containment section 28 (channel 12). The top tape 220T forms a generally inverted U-configuration which is support at the bends of the U by the sprockets and is contained along the base by the horizontal drape-defined containment section 27 (drapery slots 31—31). Each sprocket 9 is mounted on a shaft or the like which allows free rotation of the socket.

Figure 15:
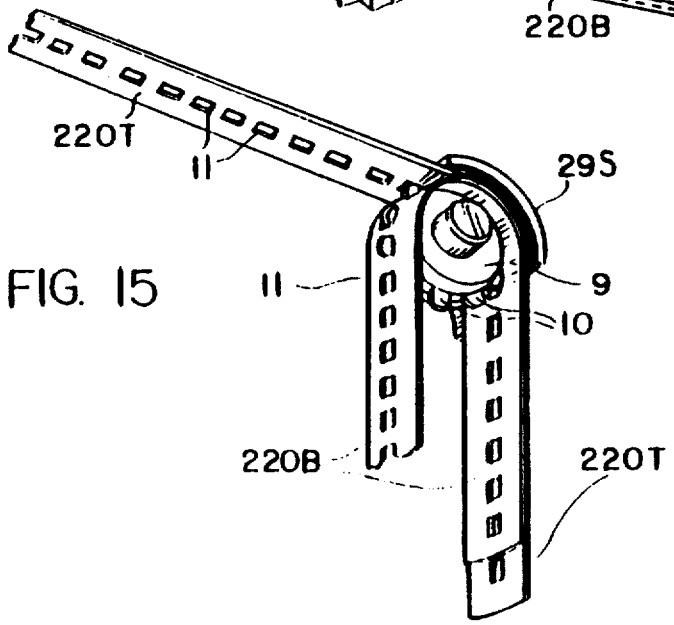
FIG. 15 is a relatively enlarged, partial perspective view of the sprocket arrangement.

As indicated in particular in FIGS. 14 and 15, the top tape 220T overlies the bottom tape 220B. Slots 11—11 formed in each tape are of equal pitch/spacing and are engaged by teeth 10 of the sprockets 9—9 so that movement of either end housing 32 (typically manually controlled movement utilizing a wand, not shown) in either the cover opening or closing direction causes the tapes 220T and 220B to wind and unwind in unison at equal velocity over the associated sprocket 9. As the result of this equal velocity movement, the push and pull force exerted by the tapes maintains the desired vertical orientation of the upright 32 and the attached drape 15 during movement. That is, the top and bottom tapes 220T and 220B displace equally, and there is no movement of the top of the upright 32 and attached drape 15 relative to the bottom thereof, or vice versa.

Containment means 25S and 29S in the form of curved fenders or guides having an interior configuration which closely matches the external periphery of the sprockets, are mounted adjacent the sprockets, for retaining the tapes on the sprockets. The guides 25S and 29S may have grooves formed along their internal periphery which allow the sprocket teeth rotate 10—10 therealong and thus permit a snug fit between the guides and the sprockets and the two tapes.

Figure 13:
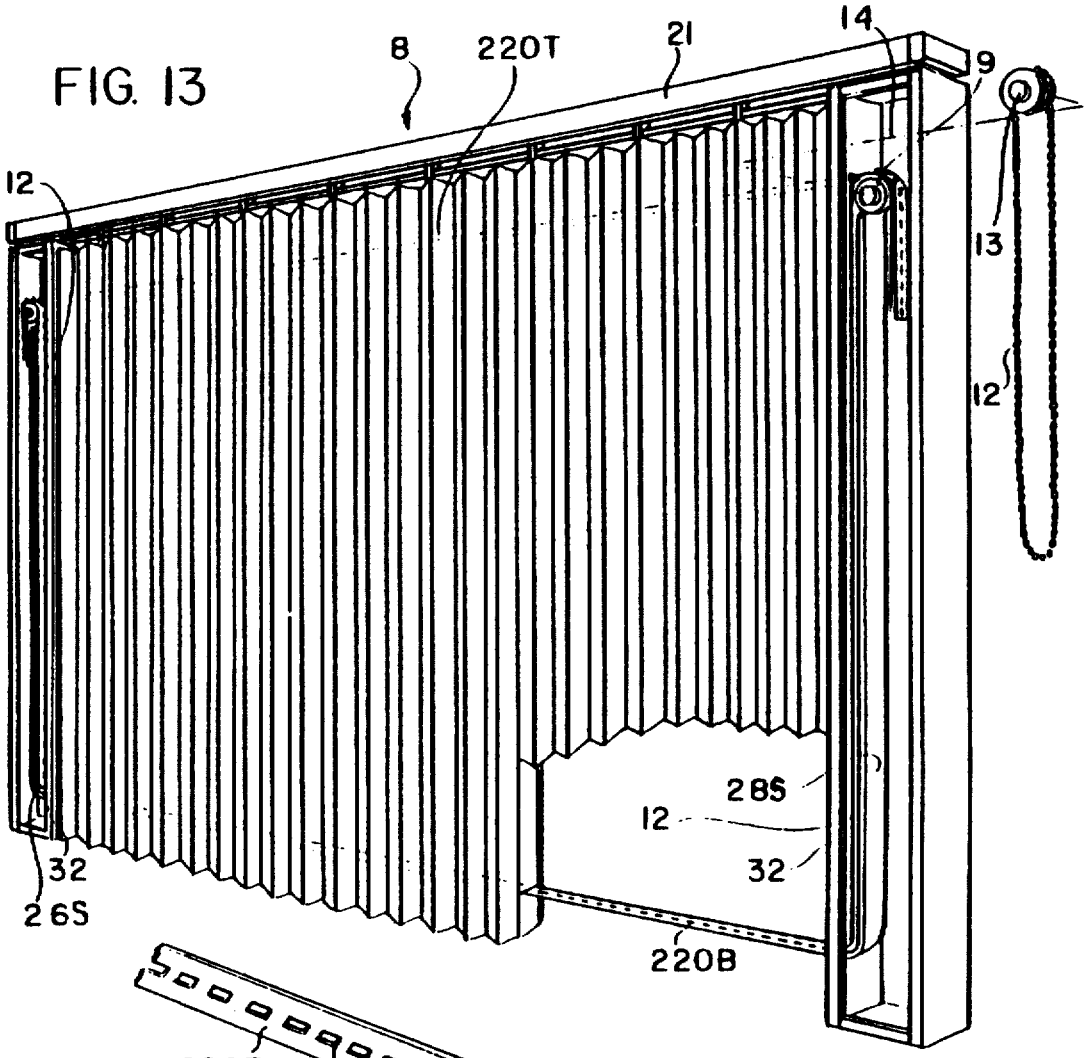
FIG. 13 is a perspective view of another embodiment of my tape-supported cover system, in this case a dual traverse sprocket-controlled system.

FIG. 13 also depicts an optional, preferred drive arrangement comprising a second sprocket 13 mounted to the sprocket 9 on the rotational axis 14 of the latter sprocket and having a drive chain 12 mounted thereon. Pulling in opposite directions (on opposite sides) of the chain 12 drives the sprocket 9 and the tapes together, in opposite directions, to open and close the cover. A low ratio gear arrangement provides very easy, smooth opening and closing movement. Alternatively, a motor drive can be used and a remote controlled, time controlled, etc. drive can be used.

Figure 17:
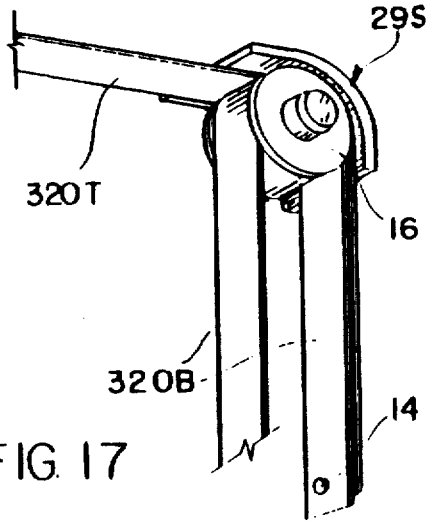
FIG. 17 is partial, perspective view of an alternative, pulley control arrangement.
Figure 16:
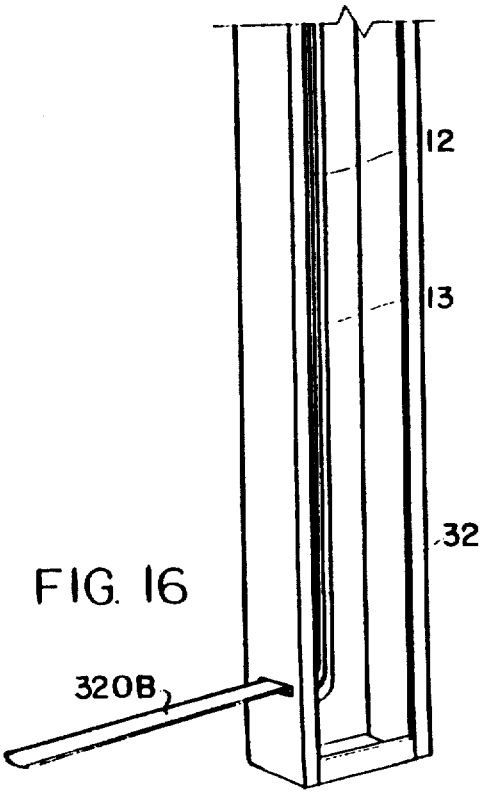
FIG. 16 is a partial perspective view of one of the vertical upright housing.

FIG. 17 depicts an alternative sprocket arrangement in which the toothed sprocket 9 is replaced by a non-toothed idler pulley 16. The controlled, equal velocity displacement of the top and bottom tapes 220T and 220B is maintained by fastening the tapes together at each end, for example, by means 14 such as a rivet or a screw.

Figure 18:
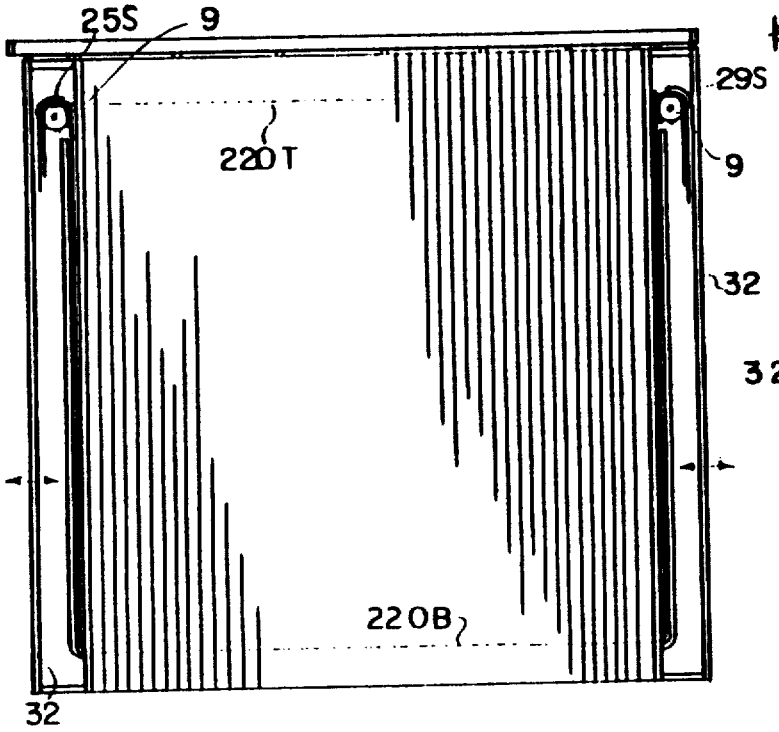
FIGS. 18 and 19 are respectively a front elevation view showing the sprocket-controlled cover in the closed position and a partial, front elevation view showing the sprocket-controlled cover in the open (drapery bunched) condition.
Figure 19:
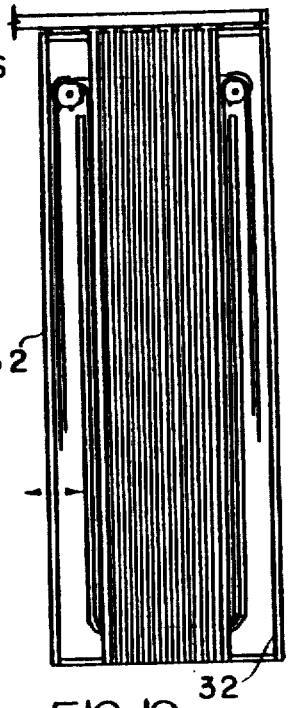

FIG. 18 depicts the cover 15 closed condition (drapery material open) while FIG. 19 depicts the cover open condition (drapery material closed or bunched) of the dual traversing system 8 depicted in FIGS. 13 through 17.

Figure 21:
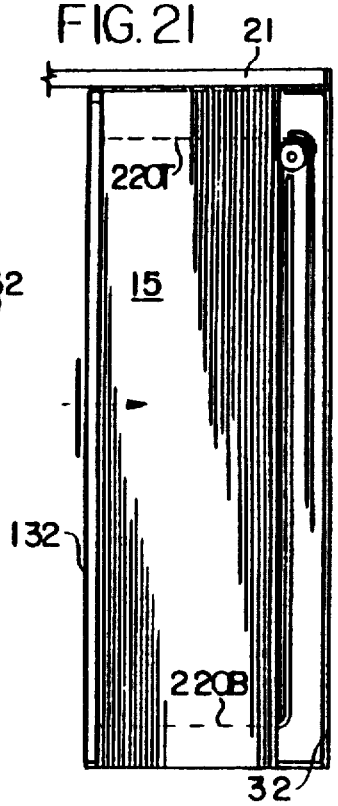
FIG. 21 is a partial front elevational view depicting the drapery closed condition of the system of FIG. 20.
Figure 22:
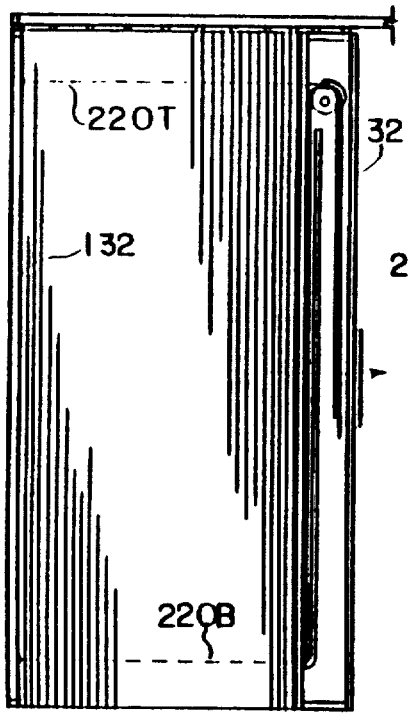
FIG. 22 is a partial front elevational view depicting the converse of the FIG. 20 arrangement, that is, a system in which the master or sprocket-containing upright is movable and the non-sprocket-containing upright is stationary.

FIGS. 20 through 22 depict various alternative embodiments of the sprocket-timed cover system 8. Although the toothed sprocket 9 is depicted in each of these alternatives, those of usual skill in the art will understand that the FIG. 17 pulley arrangement can be used as well.

FIG. 20 depicts the cover closed condition (drapery material open) of a system comprising a fixed master end housing or upright 32 containing the idler sprocket arrangement and a bi-directionally traversing opposite end comprising, for example, a simple trolley 22-mounted upright member 132, such as a slat, to which the movable drapery end is attached.

FIG. 21 depicts the cover open condition (drapery material closed or bunched) of the cover arrangement of FIG. 20.

Finally, FIG. 22 depicts the converse of the arrangement of FIGS. 20 and 21. That is, the non-sprocket upright 132 is immobile and the master, sprocket-containing traversing upright 32 is supported on the traverse track by a pulley 22 or using the elongated, rigid platform system of FIG. 1. Various other alternatives will readily occur to those of usual skill in the art, including dual traversing systems which use an upright 32 to support one end of the cover material and upright 132 to support the opposite end.

d) Tape-Supported Pleated Covers in General

FIGS. 24 through 27 illustrate the use of my tape support depicted in FIGS. 2-12 in combination with various pleated covers. FIG. 24 depicts the use of a horizontal tape to support a hollow pleated fabric cover 115 such as the DUETTE cover. FIG. 25 depicts a horizontal tape and a dual hollow pleated cover 215 such as that available from Graber, Inc. under the tradename CRSTAL PLEAT. FIG. 26 illustrates a vertical tape and a seamed pleated cover 315 such as the FINALE cover available from Verosol, USA, Inc. FIG. 27 depicts a vertical tape and a cover 415 comprising a back to back, semi-hollow arrangement of FINALE covers. As alluded to above, a horizontal tape can be substituted for vertical tape in most relatively narrow pleat covers (such as those show in FIGS. 16 and 27) by using a correspondingly relatively narrow, relatively thick or plural ply tape.

e) Tape-Supported Vertical Pleated Fabric & Blind System 218

FIGS. 28 through 30 are, respectively, a front elevational view, a rear elevational view, and a partial rear elevational view, partially cut away, illustrating a tape-supported vertical pleat silhouette blind system 218. This system combines a tape support system 20 with a vertical single pleated drape 15 and a vertical venetian blind assembly 50. The conventional blind assembly 50 comprises vertical slats 52 suspended by rotatable hangers 54 from a chain drive assembly 57 mounted within the traverse track 21. Conventionally, a gear wheel 56 is mounted at the upper end of the hangers 54 and engages chain drive so that the gears and blinds are reversibly rotated open and closed by pulling on the opposite sides of the chain pull 58. Traverse cord assembly 60 is mounted at the traversing free end of the blind and is used to pull the blind and attached drape open and closed.

The system 218 is a single traverse system in which the left drapery end (FIG. 28) is free to traverse. The system incorporates a three section tape 20 (or 120), and tape containment means 24 comprising three corresponding containment means 25, 26 and 27.

In the illustrated system 218, the blinds at the ends are replaced by generally elliptical, double convex vertical edge stabilizer members 62. The curvature of the edge stabilizer members approximates that of the slats 52, thereby providing a pleasing uniform appearance. In the illustrated single traverse system, the left end member 62 serves as the containment means 26 for the free left end of the drapery 15. Also, both ends of the drapery are wrapped around the associated members 62 and 62 to provide an enclosed, pleasing appearance.

As shown in FIG. 37, the slats 52 are supported by hinges 64. The hinges 64 comprise a snap-on slotted member 66 having a tab 67 therein which mates with a vertical slot 68 or a hole 70 in the slat. A fabric hinge 69 is adhered to the member 66 on the end opposite the slot 68 for attachment by means such as adhesive to the pleated fabric 15. Illustratively, three snap-on hinges 64 are mounted at spaced positions along the slat and the associated drape. The two bottom hinges attach to a slot 68 thereby permitting vertical self-adjustment.

Referring primarily to FIGS. 30 and 37, the containment means 27 comprises snap-on sleeve members 72 mounted on the bottom edge of the slats 52. The tape 20 is supported and routed through the sleeves 72 similar to the manner in which the fabric slots 31 depicted in FIGS. 3 and 14 support the tape.

Referring further to FIG. 30, the containment means 26 comprises the left end housing 62 which has a tube 75 mounted therein having slits 73 and 74 formed in the opposite sides at its bottom and top for routing the tape 20. Containment means 25 comprises magnet strips 33 attached to the bottom of the traverse track 21. The end 76 of the tape 20 extends through a slit 77 formed in the end panel of the traverse track 21 and is slidably secured by a finger guide 78 to the slot. When the drape 15 is closed (free end at the far left in FIGS. 30 and 37) and the blinds are rotated open or closed, slits 73 and 77 allow rotational movement of the tape end 76 about the pivot axis 79 of the end stabilizer housing 62 and thus allows opening and closing movement of the blind.

FIGS. 31–34 illustrate various positions of the system 218. Specifically, FIG. 21 illustrates the drape in the closed position with the slats 52 open. FIG. 32 illustrates the blind open condition with the slats 52 pivoted closed. FIG. 33 illustrates the blind open condition with the slats pivoted partially closed (Can the blinds completely close in this direction?). Finally, FIG. 34 illustrates the blinds open with the slats 54 open to permit close packing.

As shown for example in FIG. 31 and 37, preferably the tape 20 is mounted on the slats' pivot axis 79 defined by the gear drive and pivoting hangers. Preferably this pivot axis is positioned off-center along the transverse width of the slat, toward the front or drapery 15 side thereof, concentrating the weight of the slats on the side of the pivot axis opposite the drape. The greater weight of the blind on the free end offsets (at least partially) the weight of the fabric and facilitates smooth pivotal movement of the blind assembly. Also, the relatively short pivot on the blind side decreases the transverse displacement of the drapery between the open and closed positions of the blind. Compare, for example, the blind position in FIGS. 21 and 22. The end slats 54E are relatively short to facilitate closing without interference from housing 62. See FIG. 32.

f) Tape-Supported Vertical Pleated Fabric & Blind System 318

FIGS. 38 through 45 depict a tape-supported drapery/blind system 318 in which pivotal movement of the blind does not move the vertical edge stabilizer. Preferably, the axially off-center slat mounting arrangement discussed above is incorporated. The primary difference between the above system 218 and the system 318 is the use of pivoting tape containment housings 82. Referring primarily to FIGS. 41 through 44, the pivotal frame housing 82 comprises a generally C-shaped frame 83 having grooves 84—84 in the top and bottom edges for mounting in a slot 85 formed in the front/drapery side of the slat 54. The pivot housing 82 is substituted for the bottom hinge 64, FIG. 37. Otherwise, the slat arrangement shown in FIG. 37 is applicable to embodiment 318. A slotted pivot arm 87 is mounted for rotation about a pivot pin 88, preferably about a pivot axis which coincides with the slat pivot axis 79. The tape, illustratively a concave tape 120 (a flat tape can be used), is routed through the containment slot 86 in each pivot arm. A fabric or plastic hinge 89 pivot arm is mounted to, adhered to, or formed integrally with the pivot arm 87 at the front/drapery end of the frame for attachment to the drape, using adhesive or other suitable attachment means.

Referring to FIGS. 45 and 46, the C-shaped frames 83 are mounted to the individual slats 52 of the blind system, such that the pivot arm axes coincide with the pivot axes 79 of the slats and so that the pivot arms form the containment means 27. The hinges 89 are attached to the drapery 15 and with the two upper hinges 66, FIG. 37, support the drapery. With this independent mounting arrangement, pivotal opening and closing of the slats does not move the drapery transversely (compare FIGS. 31 and 32 with FIG. 45) or pivot the vertical edge stabilizer/containment means 62. Please note, similar to the embodiment 218, the end slats 52E are shorter than the intermediate slats 52 to facilitate closing the off-center mounted slats used in this counterbalanced arrangement.

Although the various vertical edge stabilizers can be used in the arrangement 318, the lack of pivotal movement permits very simple and thus light weight units which need only be of sufficient rigidity to contain the tape. As shown in FIGS. 39 and 40, one suitable vertical edge stiffener 92 comprises a pair of elongated mating panels 93—93 of flexible material such as plastic which are of elongated C-shaped horizontal cross-section. The ends of the panels snap together to from the vertical edge stiffener 92.

g) Tape-Supported Vertical Blind System 418

FIGS. 47 through 54 depict a tape-supported Vertical blind system 418 in which pivotal movement of the slats is independent of, that is does not move, the vertical edge stabilizer. Preferably, the above-discussed discussed axially off-center slat mounting arrangement of 318 is incorporated. The primary difference between the above system 318 and the present system 418 is the absence in the present system of any drape such as 15 and the use of a link system 95 to control the slat-to-slat spacing. Referring primarily to FIGS. 47 through 49, the pivotal frame housing comprises a generally C-shaped frame 83 having grooves 84—84 in the top and bottom edges for mounting onto a slot 85, FIG. 49, which is formed in the front side of the slat 52. See also FIG. 51. A double slotted, T-shaped pivot arm 97 is mounted for rotation about a pivot pin 88, preferably about a pivot axis which coincides with the slat pivot axis 79. Referring to FIG. 49, the C-shaped frames 83 are mounted to the individual slats 52 of the blind system, such that the pivot axes of the pivot arm coincide with the pivot axes 79 of the slats and the pivot arms 97 form the containment means 27. The tape, illustratively a flat tape 20 (a curved tape 120 can be used), is routed through the horizontal containment slot 96 in each pivot arm 97. Vertical slot 98 supports one of a group of co-operating links. Each link 99 is an elongated S of length which spans two adjacent pivot arms and establishes the maximum desired spacing between the slats 54—54.

Referring to FIGS. 47 and 48, the links 99 hide the tape. Referring also to FIG. 52, as the blind is closed (slats 52 at maximum spacing) the ends of each link 99 engage the adjacent two frame arms 83—83, thereby establishing a uniform between-slat spacing and a pleasing appearance.

As shown in FIG. 53, pivotal opening and closing of the slats does not move the vertical edge stabilizer 92 or the containment means 26/28. Please note, similar to the embodiment 218 and 318, the end slats 52E are shorter than the intermediate slats 52 to facilitate closing the offcenter mounted slats used in the counter-balanced arrangement. As shown in FIG. 54, when the blind is open (slats in the closed condition), the telescoping links 99—99 slide over one another to permit close packing.

Although the various vertical edge stabilizers can be used in the arrangement 418, the lack of pivotal movement permits very simple and thus light weight units which need be only of sufficient rigidity to contain the tape. As shown in FIG. 52 through 54 the vertical edge stiffener 92 described in FIGS. 29 and 29A can be used.

FIGS. 47 and 48 depict a two tape system (one tape at the bottom and one at the top of the blind) and two associated link systems 95. However, a single tape/single link system can be used, preferably with the tape and link system routed along the bottom of the slats to maximize the ability to control the tendency of the blind to bunch at the bottom.

Based upon the above disclosure of preferred and alternative embodiments of my invention, those of usual skill in the art will readily derive alternatives and implement modifications which are equivalent to my invention and within the scope of the claims of this patent document.

I claim:

1. A window covering system, comprising: a track; a window cover; means for mounting the window cover to the track for traversing at least one end of the cover open and closed along the track; longitudinally-rigid, transversely-flexible tape means routed through the window covering and along at least said one end of the cover, for maintaining alignment of the window cover relative to the track; and means containing the tape means against transverse movement, to effect push and pull action by the tape and provide positive displacement of the tape and the cover at the end thereof.

2. The window covering system of claim 1, wherein said at least one end of the window covering is free to traverse along the track and said tape containment means includes first containment means for routing the tape through the cover proximate the bottom of the cover and in the direction of elongation of the traverse track, second containment means for routing the tape along the free end of the cover, and third containment means for (1) securing the tape along the track when the free end of the cover traverses away from the corresponding end of the track and (2) releasing the tape when the free end of the cover traverses toward the corresponding end of the track; said second containment means including an edge stabilizer member mounted along the free end of the cover and extending transverse to the track.

3. The window covering system of claim 1, wherein said at least one end of the window cover is free to traverse along the track; and further comprising at least one edge stabilizer member mounted along the free end of the window cover and extending traverse to the track; said tape means being routed through the window cover and vertically through the edge stabilizer member; the tape means comprising first and second tapes routed through he window cover along vertically spaced horizontal paths; a pulley mounted to the edge stabilizer member for rotation; and wherein the tapes are routed over the pulley and the ends of the tape are attached together, for ensuring movement of the tapes in unison.

4. The window covering system of claim 1, wherein at least one end of the window cover is free to traverse along the track; and further comprising at least one edge stabilizer member mounted along the free end of the window cover and extending transverse to the track; said tape means being routed through the window cover and vertically through the edge stabilizer member; the tape means comprising first and second tapes routed through the window cover along vertically spaced horizontal paths; a sprocket mounted to the edge stabilizer member for rotation; and wherein the tapes contain slots therein and are routed over the pulley such that the slots are engaged by the sprocket for ensuring movement of the tapes in unison.

5. The window covering system of claim 3, wherein edge stabilizer members are mounted along both ends of the window cover; wherein both ends of the window cover are free to traverse along the track; and wherein a pulley is mounted in each of the vertical edge stabilizer members and the tapes are routed over each pulley for ensuring movement of the tapes in unison.

6. The window covering system of claim 4, wherein edge stabilizer members are mounted along both ends of the window cover; wherein both ends of the window cover are free to traverse along the track; and wherein a sprocket is mounted in each of the vertical edge stabilizer members and the tapes are routed over each sprocket for ensuring movement of the tapes in unison.

7. The window covering of claim 1, wherein the cover is a prepleated material.

8. The window covering of claim 1, wherein the cover is a prepleated hollow cell material.

9. A window covering system, comprising: an elongated traverse track, a plurality of trolleys mounted on the track for traversing along the track; a cover attached to the trolleys and having at least one free end supported by the trolleys for traversing along the track; a tape routed along the cover in the general direction of traverse, along the free end of the cover and along the track at the free end of the cover for supporting the cover, said tape being relatively rigid in the longitudinal direction and relatively flexible transverse to the longitudinal direction; and tape containment means surrounding the tape for securing the tape against transverse displacement, whereby the tape is effective in pushing and pulling the cover and provides full displacement of the tape between the track and the bottom of the cover, thereby maintaining the vertical orientation of the free end.

10. The window covering system of claim 9, wherein the tape containment means comprises: first containment means for routing the tape proximate the bottom of the cover and in the direction of elongation of the traverse track; second containment means for routing the tape along the free end of the cover; and third containment means for (1) securing the tape along the track when the free end traverses away from the corresponding end of the track and (2) releasing the tape when the cover traverses toward the corresponding end of the track.

11. The window covering system of claim 9, wherein the first containment means comprises slots formed in the cover defining the path of the tape.

12. The window covering system of claim 9, wherein the second containment means comprises a hollow upright member attached proximate the free end of the cover and oriented transverse to the direction of elongation of the traverse track.

13. The window covering system of claim 9, wherein the third containment means comprises a magnet or array of magnets positioned along the traverse track.

14. The window covering system of claim 12, further comprising adjustable brake means mounted on the member and interacting with the tape for adjustably braking the movement thereof.

15. The window covering system of claim 9, wherein the tape is flat.

16. The window covering system of claim 9, wherein the tape is concave.

17. The window covering system of claim 9, wherein the tape is concave and is oriented with the concavity facing radially inward at the bends in the tape.

18. The window covering system of claim 17, wherein the tape is rotated between bends to maintain the concavity facing radially inward at the bends.

19. The window covering system of claim 9, wherein the tape bends around the edges of the cover between the first and second containment means and between the second and third containment means.

20. The window covering system of claim 19, wherein the tape is concave and is oriented with the concavity facing radially inward at the bends.

21. The window covering system of claim 20, wherein the tape is rotated between bends to maintain the concavity facing radially inward at the bends.

22. The window covering of claim 9, wherein the cover is a prepleated material.

23. The window covering of claim 9, wherein the cover is a prepleated hollow cell material.

* * * * *